US008136932B2

(12) United States Patent
Nozawa et al.

(10) Patent No.: US 8,136,932 B2
(45) Date of Patent: Mar. 20, 2012

(54) LIQUID STORAGE CONTAINER AND LIQUID FILLING METHOD AND LIQUID REFILLING METHOD USING THE SAME

(75) Inventors: Izumi Nozawa, Matsumoto (JP); Hitotoshi Kimura, Matsumoto (JP); Hitoshi Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 912 days.

(21) Appl. No.: 12/168,716

(22) Filed: Jul. 7, 2008

(65) Prior Publication Data

US 2009/0015642 A1 Jan. 15, 2009

(30) Foreign Application Priority Data

Jul. 10, 2007 (JP) ..... 2007-180528
Jul. 10, 2007 (JP) ..... 2007-180529
May 13, 2008 (JP) ..... 2008-125576

(51) Int. Cl.
*B41J 2/17* (2006.01)
*B41J 2/175* (2006.01)

(52) U.S. Cl. ..... 347/86; 347/84; 347/85

(58) Field of Classification Search ..... None
See application file for complete search history.

(56) References Cited

U.S. PATENT DOCUMENTS 5,574,490 A * 11/1996 Gragg et al. ..... 347/87
5,950,403 A 9/1999 Yamaguchi et al.
6,224,199 B1 5/2001 Yamaguchi et al.
6,289,654 B1 9/2001 Yamaguchi et al.
7,311,761 B2 * 12/2007 Ishizawa et al. ..... 96/6
7,357,495 B2 * 4/2008 Matsumoto ..... 347/86
7,367,663 B2 * 5/2008 Matsumoto ..... 347/86
7,393,089 B2 7/2008 Yamaguchi et al.
7,455,396 B2 11/2008 Wakayama
7,674,322 B2 * 3/2010 Ishizawa et al. ..... 96/6
2002/0071013 A1 * 6/2002 Hsu et al. ..... 347/86
2007/0046743 A1 3/2007 Wakayama

FOREIGN PATENT DOCUMENTS

JP 01-208145 8/1989
JP 2000-318179 A 11/2000
JP 2001-353881 A 12/2001
JP 2002-192742 7/2002
JP 2004-209994 A 7/2004
JP 2005-066520 3/2005
JP 2005067094 A * 3/2005
JP 2005-169851 6/2005
JP 2005-186478 A 7/2005
JP 2006-069129 3/2006
JP 2007098857 A 4/2007
JP 2007-136979 A 6/2007
WO 2005037560 A1 4/2005

* cited by examiner

*Primary Examiner* — Matthew Luu
*Assistant Examiner* — Renee I Wilson

(57) ABSTRACT

A liquid storage container includes a liquid containing body that is formed of a flexible film and contains liquid therein; a liquid lead-out member connected to the liquid containing body; and a spacer member disposed in the liquid containing body. The liquid containing body deforms in a direction in which inner wall surfaces of the flexible film facing each other are brought into contact with each other at the time of reduction in the remaining amount of the liquid as the inside liquid is taken out through the liquid lead-out member, and the spacer member regulates contact between parts of the inner wall surfaces of the flexible film facing each other at the time of reduction in the remaining amount of the liquid to thereby form a remaining liquid space where liquid remains.

11 Claims, 19 Drawing Sheets

LIQUID STORAGE CONTAINER AND LIQUID FILLING METHOD AND LIQUID REFILLING METHOD USING THE SAME

BACKGROUND

1. Technical Field

The present invention relates to a liquid storage container and a liquid filling method and a liquid refilling method using the same that are suitable in a case where liquid allowing dispersoid formed of particles, such as a pigment, to easily sediment in a dispersion medium, such as a solvent, is used.

2. Related Art

Ink jet printers have been widely used as liquid ejecting apparatuses that eject liquid onto a target. More specifically, the ink jet printer includes a carriage, a recording head mounted on the carriage, and an ink container that stores ink as liquid. Printing is performed on a recording medium by supplying ink from an ink pack of the ink container to the recording head and discharging (ejecting) ink from a nozzle of the recording head while making the carriage relatively move with respect to the recording medium.

As printing is diversified in recent years, pigment dispersed ink or ink in which various kinds of powder are dispersed in a solvent (hereinafter, referred to as 'pigment ink') is increasingly used. This pigment ink uses a pigment as a coloring matter and is obtained by dispersing the pigment in an ink solvent (dispersion medium). If the pigment ink is left alone for a long period of time, a problem that the pigment sediments in the solvent occurs because the pigment itself is dispersed as particles in the ink solvent, even though a printed matter using the pigment ink has excellent light-resistant property and water-resistant property.

For this reason, in the case where the idle period of a printer is relatively long or a new ink cartridge is used, concentration unevenness that the pigment concentration is low at an upper side of an ink pack and is high at a lower side of the ink pack due to sedimentation of the pigment occurs. As a result, a problem that concentration unevenness occurs in printing arises. In an extreme case, a condensed pigment clogs a filter member extending up to a recording head or enters into a complicated ink passage formed in the recording head to clog the portion. This may eventually cause ink droplets not to be discharged from the recording head.

For example, JP-A-2002-192742 (refer to FIGS. 4 to 7) discloses that in a printer and an ink cartridge using pigment ink, for example, vibration generated by a piezoelectric element is transmitted to the ink cartridge so that ink stored in the ink cartridge can be vibrated to be stirred.

JP-A-2005-66520 (refer to FIG. 2) discloses that concentration unevenness of ink within an ink pack is prevented by extending an operated portion of a stirring body, which is rocked by a driving portion, to the end of the ink pack located opposite a side where a liquid lead-out member protrudes from the ink pack.

In addition, examples in which various kinds of members are disposed within a liquid containing body are disclosed in JP-A-1-208145 (refer to FIGS. 2 and 3) and JP-A-2006-69129 (refer to FIGS. 12 and 13). JP-A-1-208145 discloses that vacuum portions enclosed by a partition wall member, which is insoluble in an ink composition and has gas permeability, are disposed even in an ink pack. Here, dissolved gas is diffused to the vacuum portion by partial pressure such that the concentration of nitrogen or oxygen dissolved in ink is decreased, thereby reducing a temporal change of ink. However, prevention of the concentration unevenness is not disclosed in JP-A-1-208145. JP-A-2006-69129 disposes that a movable stirring body that sediments and a floating body that floats are disposed in an ink containing chamber of an on-carriage type ink cartridge. Ink is stirred by moving the movable stirring body with the movement of a carriage, and generation of abnormal noises caused by collision of the movable stirring body with an inner wall of the ink containing chamber at the time of a decrease in the amount of remaining ink is reduced.

In the case of the technique disclosed in JP-A-2002-192742, there was a problem that the vibration effect was not sufficient since the vibration was given from the outside of ink. For example, there was a case in which vibration was absorbed in a member of a tank to become weak or was transmitted only to the neighborhood of a wall surface of a tank and accordingly, sufficient stirring could not be expected. In addition, when vibration was generated, it was difficult to sufficiently stir the whole ink even if the neighborhood of a place where the vibration was generated was stirred.

An ink pack deforms as ink is taken out and changes to the volume according to the amount of remaining ink. In the technique of stirring ink in the liquid containing body as disclosed in JP-A-2005-66520, the amount of displacement of the stirring body is decreased when the amount of remaining ink is reduced due to obstruction of the inner wall of the ink pack. Therefore, the ink stirring effect particularly when the amount of remaining ink is reduced is small.

The technique disclosed in JP-A-2006-69129 can be applied only to the on-carriage type ink cartridge but cannot be applied to an off-carriage type ink cartridge.

SUMMARY

An advantage of some aspects of the invention is that it provides a liquid storage container and a liquid filling method and a liquid refilling method using the same that do not allow liquid, which is a cause of poor quality or malfunction, to be discharged without adopting the technique of stirring liquid by applying vibration in the inside or outside of a liquid containing body as disclosed in JP-A-2002-192742, JP-A-2005-66520, and JP-A-1-208145.

According to an aspect of the invention, a liquid storage container includes: a liquid containing body that is formed of a flexible film and contains liquid therein; a liquid lead-out member connected to the liquid containing body; and a spacer member disposed in the liquid containing body. The liquid containing body deforms in a direction in which inner wall surfaces of the flexible film facing each other are brought into contact with each other at the time of reduction in the remaining amount of the liquid as the inside liquid is taken out through the liquid lead-out member, and the spacer member regulates contact between parts of the inner wall surfaces of the flexible film facing each other at the time of reduction in the remaining amount of the liquid to thereby form a remaining liquid space where liquid remains.

According to the aspect of the invention, the spacer member may form the remaining liquid space, in which liquid remains, between the inner wall surfaces of the flexible film facing each other at the time of reduction in the amount of remaining liquid. Thus, by causing liquid that remains in the remaining liquid space not to be taken out, a trouble occurring due to taking out liquid that remains within the liquid containing body to the last can be prevented.

In the liquid storage container according to the aspect of the invention, the spacer member may be disposed at a lower side of the liquid containing body in the gravity direction. In this manner, the spacer member can be held at the approximately fixed position within the liquid containing body. In order to make the spacer member sediment within the liquid containing body, it is preferable to form the spacer member by using a material having a larger specific gravity than the liquid. Alternatively, a weight member that is connected to the spacer member and serves to dispose the spacer member at the lower side of the liquid containing body in the gravity direction may be further provided. In this case, the spacer member may be formed of a material having a smaller specific gravity than the liquid.

In the liquid storage container according to the aspect of the invention, it may be possible to further include a contact regulating member that is in contact with the parts of the inner wall surfaces of the flexible film facing each other at the time of reduction in the remaining amount of the liquid to thereby regulate that the parts of the inner wall surfaces are brought into contact with each other. That is, a space member having any shape may be used as long as the space member has a structure of regulating contact between the parts of the inner wall surfaces of the flexible film facing each other.

In the liquid storage container according to the aspect of the invention, the contact regulating member may be formed in a shape allowing the liquid to flow inside and outside the remaining liquid space. In this manner, free input/output of the liquid to/from the remaining liquid space can be secured even at the time of reduction in the amount of remaining liquid. Accordingly, particularly even at the time of reduction in the amount of remaining liquid, liquid which sediments in a lower region, for example, within the ink containing body can be free to move into the remaining liquid space in the spacer member.

In the liquid storage container according to the aspect of the invention, the contact regulating member may include a partition forming member that partitions the remaining liquid space into a plurality of chambers, and the partition forming member may be formed in a shape allowing the liquid to flow between adjacent ones of the plurality of chambers. By providing the partition forming member, the inner wall surfaces of the flexible film facing each other become difficult to bend. As a result, the volume of the remaining liquid space originally designed can be secured. In addition, since the liquid can flow between chambers even if the remaining liquid space is partitioned into the plurality of chambers, the liquid flow in the remaining liquid space is not obstructed.

In the liquid storage container according to the aspect of the invention, the contact regulating member may include an outer shell member that has a predetermined height in a direction crossing the inner wall surfaces facing each other and partitions the remaining liquid space. By providing the outer shell member, an outer surface of the spacer member becomes smooth. As a result, it becomes easy to insert the spacer member into the liquid containing body at the time of assembling of the liquid storage container.

As liquid contained in the liquid storage container of the invention, all kinds of liquid the remaining amount of which is not to be taken out may be applied. However, for example, liquid which contains a plurality of kinds of components and in which the specific gravity of at least one kind of component is larger than that of another kind of component may be mentioned. An example of such liquid includes ink containing a medium heavier than a solvent, for example, a pigment. In such kind of ink, the pig easily sediments in a lower region of a liquid containing body.

In the liquid storage container according to the aspect of the invention, assuming that pressure for deformation in a direction where the inner wall surfaces of the two flexible film facing each other are brought into contact with each other when the liquid is taken out is set as first pressure, the contact regulating member may elastically deform in a direction in which the remaining liquid space is reduced when second pressure exceeding the first pressure is given. In this manner, the remaining liquid space is reduced at the time of liquid filling so that the air is difficult to be mixed, and the remaining liquid space is expanded when liquid is taken out so that a predetermined amount of remaining liquid can be held.

According to another aspect of the invention, a liquid filling method of filling liquid into the liquid storage container described above includes: forming a space by deforming the flexible film in the direction, in which the inner wall surfaces of the flexible film facing each other are brought into contact with each other, in a state where the spacer member is disposed at the position opposite the liquid lead-out member to thereby exhaust the air within the liquid containing body and regulating contact between parts of the inner wall surfaces of the flexible film facing each other at the time of exhaust by the use of the spacer member; injecting a predetermined amount of liquid into the liquid containing body including the space formed in the spacer member in a state where the liquid lead-out member faces upward in the gravity direction and then exhausting the air again; and filling the liquid containing body with liquid.

In this liquid filling method, the air remains in a space formed by the spacer member when the air is first exhausted. Accordingly, a predetermined amount of liquid is injected into the liquid containing body including the space after the air exhaust, pushing the light air upward in the gravity direction, and then the air within the liquid storage container is discharged. In this case, if the spacer member is moved within the liquid containing body such that the spacer member is disposed at the position opposite the liquid lead-out member, the air exhaust and liquid filling can be executed smoothly.

According to still another aspect of the invention, a liquid filling method of filling the liquid into a liquid storage container having a spacer member that elastically deforms includes: exhausting the air within the liquid containing body by elastically deforming the contact regulating member under the second pressure in a state where the spacer member is disposed at the position opposite the liquid lead-out member; and filling the liquid containing body with the liquid.

In this case, the air within the spacer member can also be discharged by elastically deforming the contact regulating member under the second pressure to exhaust the air within the liquid containing body. Also in this case, if the spacer member is moved within the liquid containing body such that the spacer member is disposed at the position opposite the liquid lead-out member, the air exhaust and liquid filling can be executed smoothly.

According to still another aspect of the invention, a liquid refilling method of refilling the liquid into the liquid containing body after the liquid in the liquid storage container described above is taken out and is then recovered from the market includes: discharging liquid remaining within the remaining liquid space in a state where the spacer member is disposed at the position opposite the liquid lead-out member; exhausting the air from the space within the spacer member after injecting a predetermined amount of liquid into the liquid containing body including the space formed in the spacer member in a state where the liquid lead-out member faces upward in the gravity direction; and refilling the liquid containing body with liquid.

Since liquid remains in the spacer member of the liquid storage container recovered from the market, the remaining liquid is first discharged by using the gravity, for example. Subsequently, light air is pushed upward in the gravity direction by introducing liquid into the space within the spacer member, and then the air in the liquid storage container is discharged. As a result, refilling of liquid becomes possible. Also in this case, if the spacer member is moved within the liquid containing body such that the spacer member is disposed at the position opposite the liquid lead-out member, the air exhaust and liquid refilling can be executed smoothly.

According to still another aspect of the invention, a liquid refilling method of refilling the liquid into the liquid containing body after the liquid in a liquid storage container having an elastically deformable spacer member is taken out and is then recovered from the market includes: discharging remaining liquid within the remaining liquid space and exhausting the air within the liquid containing body by elastically deforming the contact regulating member under the second pressure in a state where the spacer member is disposed at the position opposite the liquid lead-out member; and refilling the liquid containing body with the liquid.

Also in this case, since liquid remains in the spacer member of the liquid storage container recovered from the market, the remaining liquid is first discharged by using the gravity, for example. Subsequently, the air within the liquid containing body including the spacer member can also be discharged by elastically deforming the contact regulating member under the second pressure to exhaust the air within the liquid containing body. In this case, if the spacer member is moved within the liquid containing body such that the spacer member is disposed at the position opposite the liquid lead-out member, the air exhaust and liquid filling can be executed smoothly.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described in detail. In addition, the present embodiments to be described below do not unduly limit the contents of the invention as defined in the appended claims, and all constituent elements described in the present embodiments are not necessarily indispensable as a solving means of the invention.

First Embodiment

Outline of a Liquid Ejecting Apparatus

Figure 1:
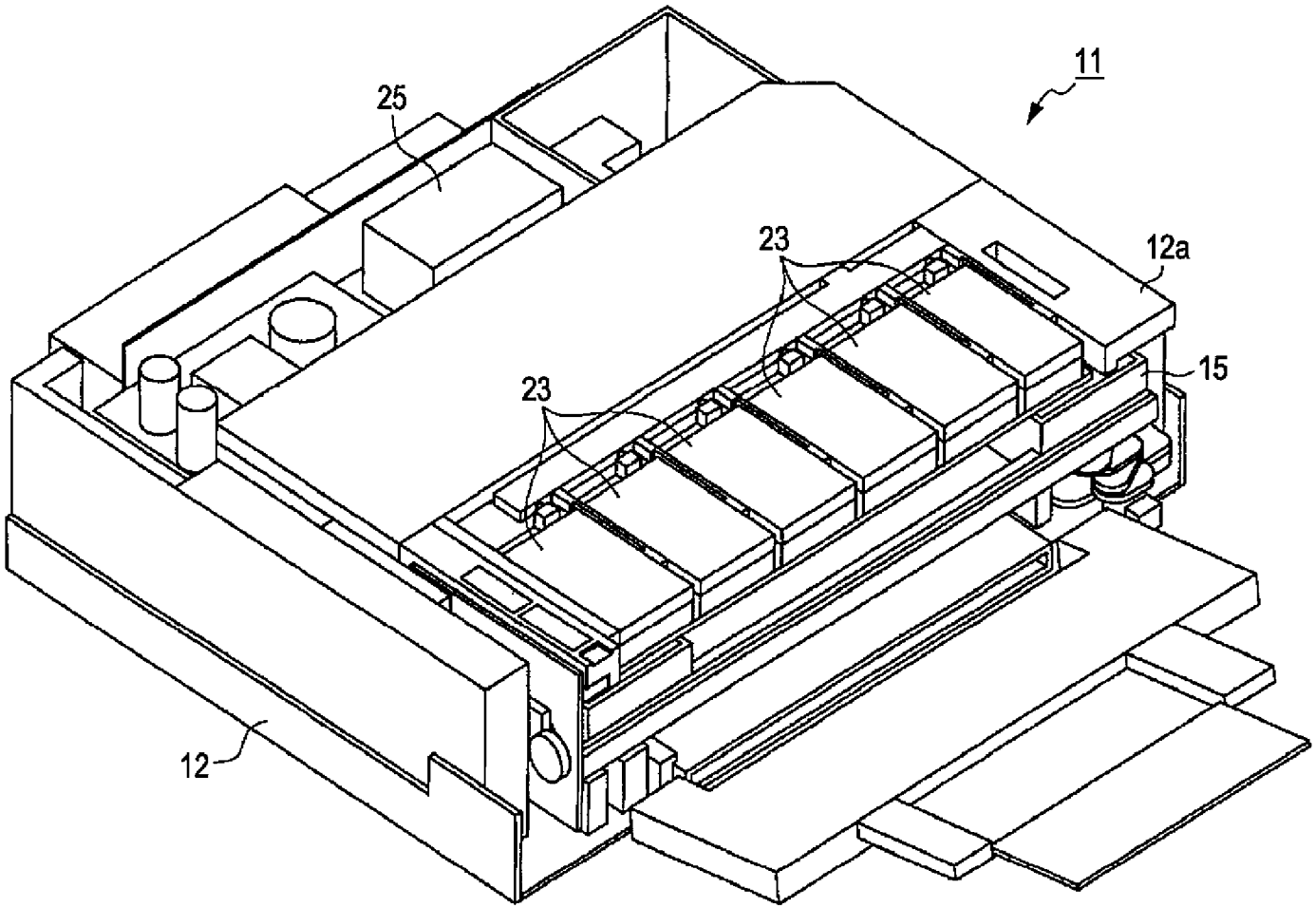
FIG. 1 is a perspective view illustrating a printer according to a first embodiment of the invention.

As shown in FIG. 1, a printer 11 as a liquid ejecting apparatus according to the embodiment is covered with a frame 12. In addition, as shown in FIG. 2, a guide shaft 14, a carriage 15, a recording head 20 serving as a liquid ejecting head, a valve unit 21, an ink cartridge 23 (refer to FIG. 1) serving as a liquid storage container, and a pressure pump 25 (refer to FIG. 1) are provided inside the frame 12.

As shown in FIG. 1, the frame 12 is a housing having an approximately rectangular parallelepiped shape, and a cartridge holder 12*a* is formed on a front surface thereof.

Figure 2:
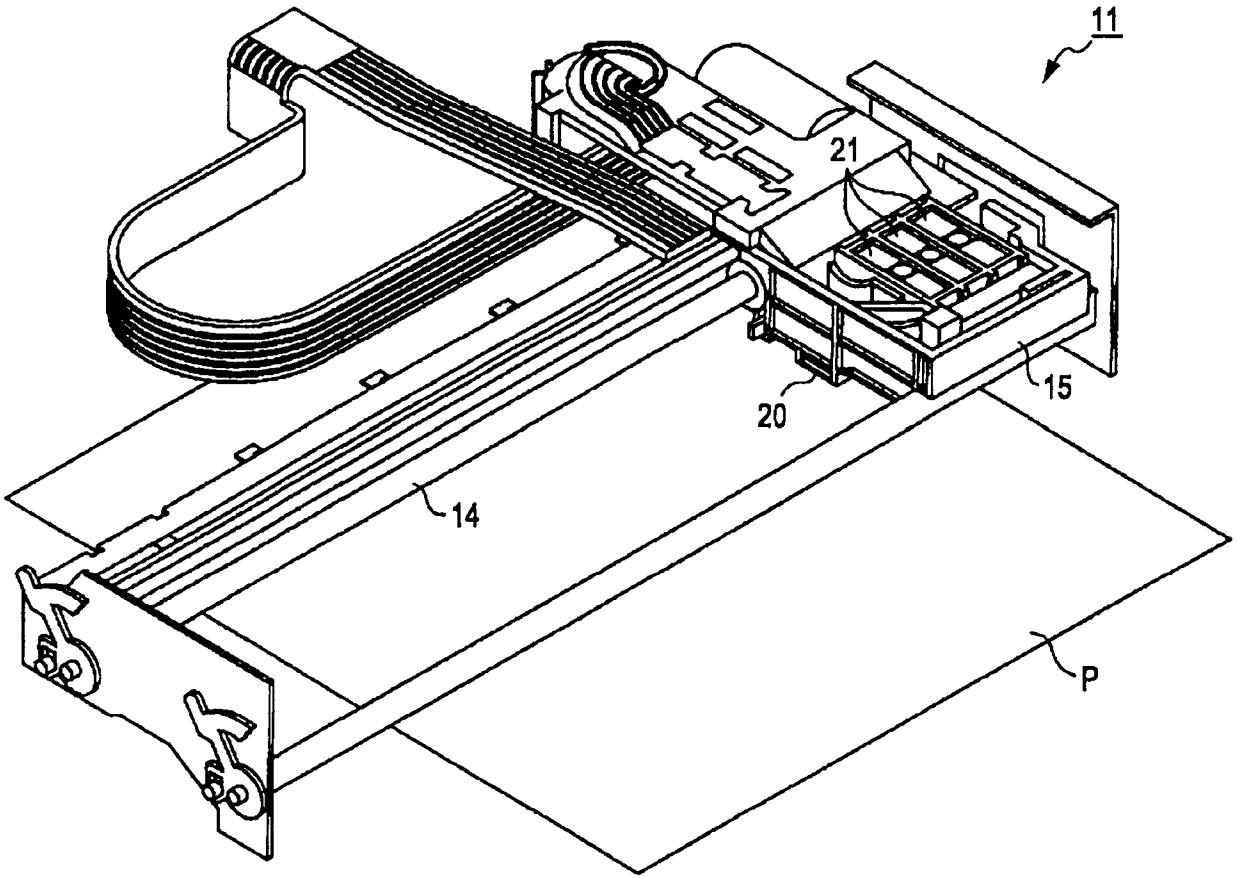
FIG. 2 is an exploded perspective view illustrating the printer shown in FIG. 1.

As shown in FIG. 2, the guide shaft 14 is formed in a cylindrical shape and provided within the frame 12. In addition, in the present embodiment, the direction in which the guide shaft 14 is provided is assumed to be a main scanning direction. The guide shaft 14 is provided to penetrate through the carriage 15 so that the carriage 15 can move relatively with respect to the guide shaft 14, and the carriage 15 can reciprocate in the main scanning direction. In addition, the carriage 15 is connected to a carriage motor (not shown) through a timing belt (not shown). The carriage motor is supported by the frame 12. When the carriage motor is driven, the carriage 15 is driven through the timing belt, in such a manner that the carriage 15 reciprocates along the guide shaft 14, that is, in the main scanning direction.

The recording head 20 provided on a bottom surface of the carriage 15 includes a plurality of nozzles (not shown) used to make ink as liquid ejected therethrough. In addition, the recording head 20 performs recording of print data, such as an image or a character, by discharging ink droplets on a print medium, such as recording paper. The valve unit 21 is mounted on the carriage 15 and serves to supply ink, which is temporarily stored, to the recording head 20 in a condition where the pressure is adjusted.

Furthermore, in the present embodiment, the valve unit 21 is configured to be able to supply one or two kinds of ink to the recording head 20 separately in a condition where the pressure is adjusted. Furthermore, in the present embodiment, three valve units 21 are provided corresponding to six ink colors (black, yellow, magenta, cyan, light magenta, light cyan).

In addition, a platen (not shown) is provided below the recording head 20. This platen supports a recording medium serving as a target which is fed in the sub-scanning direction perpendicular to the main scanning direction by a paper feed unit (not shown).

Liquid Storage Container

As shown in FIG. 1, the ink cartridge 23 that is a liquid storage container is detachably provided in the cartridge holder 12*a*, and six ink cartridges 23 are provided corresponding to the above-described ink colors. The structure of the ink cartridge 23 will be described with reference to FIGS. 3 to 5.

Figure 3:
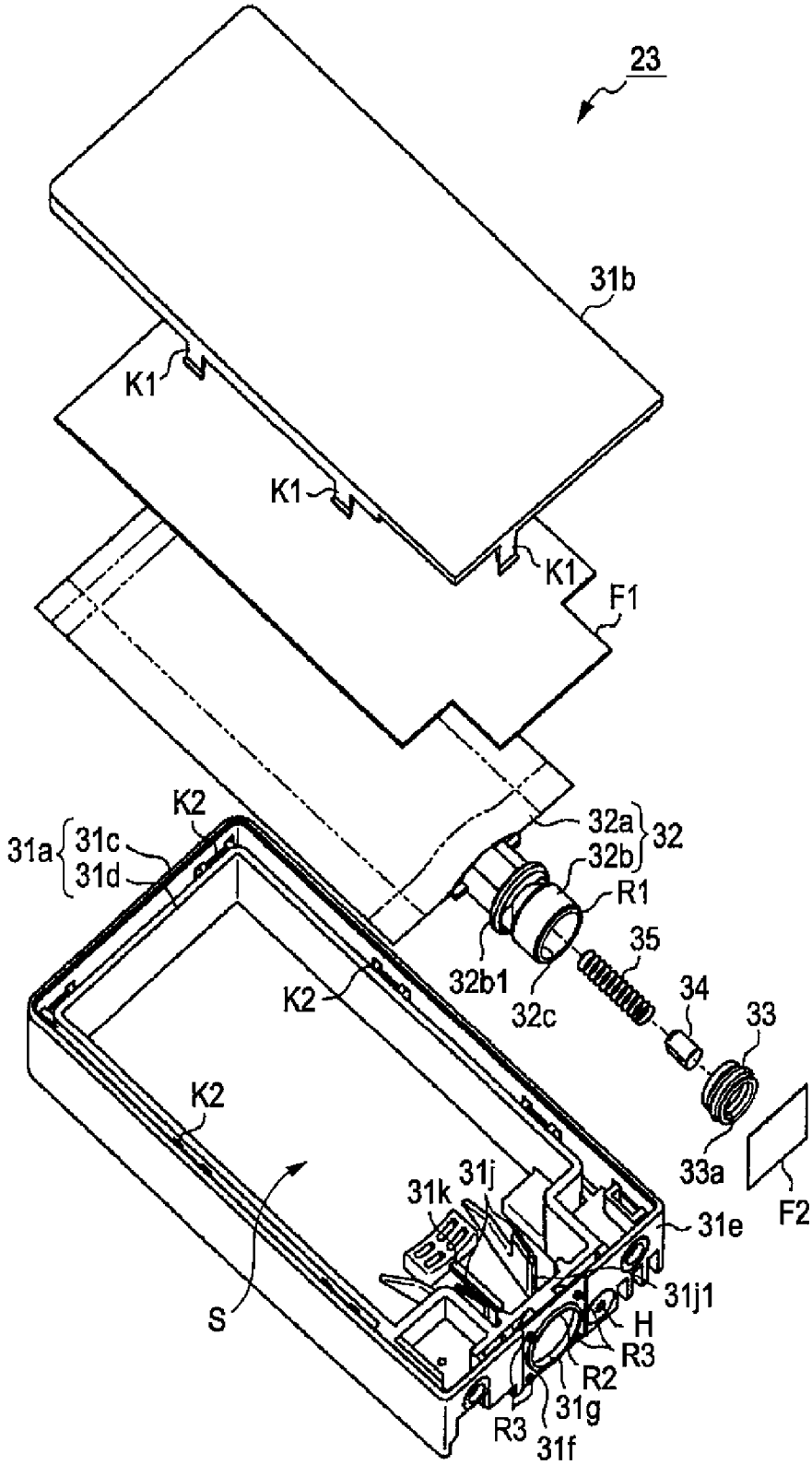
FIG. 3 is an exploded perspective view illustrating an ink cartridge shown in FIG. 1.

As shown in FIG. 3, the ink cartridge 23 includes a main body case 31*a*, an upper case 31*b*, and an ink pack 32 as a liquid containing bag. In addition, an ink case 31 as a case is formed by using the main body case 31*a* and the upper case 31*b*, and the ink pack 32 is placed in the case. In addition, in FIG. 3, only one of the six ink cartridges 23 is illustrated and the five remaining ink cartridges 23 are not illustrated since the six ink cartridges 23 have the same structure.

As shown in FIG. 3, the ink pack 32 includes an ink bag 32*a* that is a flexible portion, an ink lead-out member 32*b* as a liquid lead-out portion, and a sealing member 33. The ink bag 32*a* is formed of a material having flexibility and gas barrier property. For example, the ink bag 32*a* is formed by overlapping two aluminum-laminated sealed films each having a configuration, in which an outer side is formed of a nylon sealed film and an inner side is formed of a sealed film, such as polypropylene or polyethylene, and bonding the periphery in a method, such as heat welding.

The ink lead-out member 32*b* is formed of polypropylene, for example, and is attached to the ink bag 32*a* by using a method, such as heat welding. Specifically, the ink bag 32*a* is formed by bonding three sides of the two overlapping aluminum-laminated sealed films by heat welding after forming the ink pack 32 and then performing heat welding of one remaining side in a state where the ink lead-out member 32*b* is placed in the middle of the remaining side. Ink within the ink bag 32*a* is accommodated in a degassed state. The ink lead-out member 32*b* has an approximately cylindrical shape, and the inside of the ink lead-out member 32*b* forms an ink lead-out port 32*c* that is a liquid passage. Ink contained in the ink bag 32*a* is taken out through the ink lead-out port 32*c*.

Figure 4:
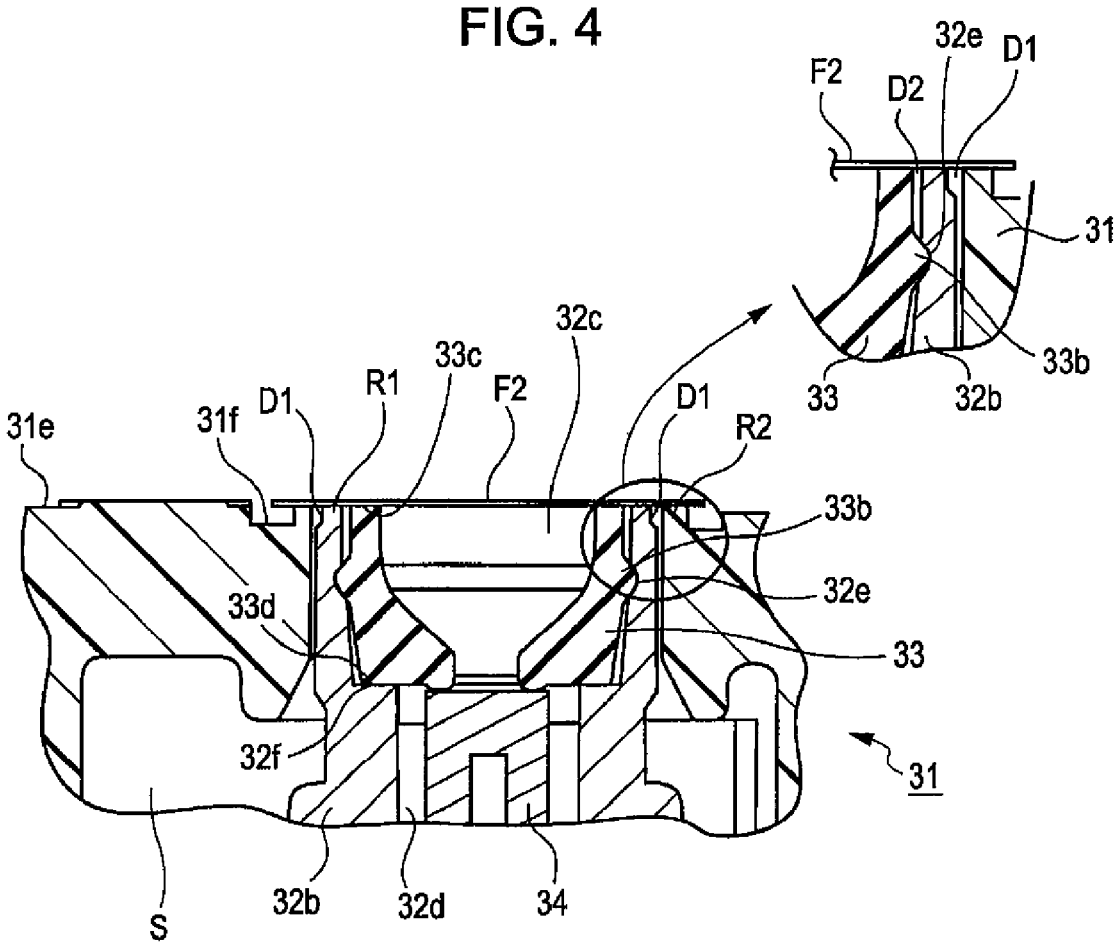
FIG. 4 is a partially sectional view illustrating the ink cartridge.

In addition, a valve mechanism opened only at the time of ink supply is provided in the ink lead-out port 32*c*, such that ink in the ink bag 32*a* does not leak out. More specifically, the valve mechanism of the ink lead-out port 32*c* is in the ink lead-out port 32*c* of the ink lead-out member 32*b*. The valve mechanism is disposed at the inner side than the sealing member 33. This valve mechanism has a valve body 34, which is disposed to be able to be in contact with the sealing member 33, and a spring member 35 as a biasing member that biases the valve body 34 to be pressed against the sealing member 33. The spring member 35 biases the valve body 34 toward a side of the sealing member 33. As a result, the valve body 34 blocks a supply port 33*a* of the sealing member 33 as shown in FIG. 4. In addition, the supply port 33*a* is covered with a sealing film F2. This sealing film F2 will be described later.

When the ink cartridge 23 is disposed in the cartridge holder 12*a*, an ink supply needle 40 as a liquid lead-out needle formed in the liquid ejecting apparatus breaks through the sealing film F2 to be inserted into the ink lead-out member 32*b*. In addition, the ink supply needle 40 presses the valve body 34 to a side of the ink bag 32*a* against the elastic force of the spring member 35 (refer to FIG. 5). When the valve body 34 is spaced apart from the sealing member 33, ink of the ink bag 32*a* flows from a gap between the sealing member 33 and the valve body 34 to the outside through a plurality of holes 40*a* provided on the tip of the ink supply needle 40.

That is, the sealing member 33 functions as a valve seat member against which the valve body 34 is pressed to block the ink lead-out port 32*c* before the ink supply needle 40 is inserted. In addition, when the ink supply needle 40 is inserted, the valve body 34 is spaced apart from the sealing member 33 against the biasing force of the spring member 35 caused by the ink supply needle 40, opening the ink lead-out port 32*c*.

As shown in FIG. 3, the main body case 31*a* is configured to include an outer case 31*c* and an inner case 31*d*, each of which is formed of polypropylene or polyethylene. The outer case 31*c* is a housing which has an approximately rectangular parallelepiped shape and an upper side of which is opened. The inner case 31*d* is smaller than the outer case 31*c* over the entire periphery and has a shape similar to the ink pack 32 to regulate that the ink pack 32 moves according to the movement of the ink case 31. The upper case 31*b* is an approximately quadrangular plate-shaped body put on an upper surface of the main body case 31*a* and is formed of polypropylene, for example. A locking piece K1 is provided in a predetermined place of the upper case 31*b*, such that the locking piece K1 is engaged to an engaging member K2 formed between the outer case 31*c* and the inner case 31*d* when the upper case 31*b* is placed on the upper surface of the main body case 31*a*.

A supply port anchoring portion 31*f* having a square shape is formed in the middle of a front surface 31*e* of the main body case 31*a*. The supply port anchoring portion 31*f* is provided with an opening 31*g* communicating with the inner case 31*d*. Moreover, in the opening edge of the opening 31*g*, an annular protruding portion R2 is formed to protrude toward the outside direction of the ink case 31 along the opening edge. In addition, in four corners of the supply port anchoring portion 31*f*, cylindrical independent protruding portions R3 are formed to protrude toward the outside direction of the ink case 31 with the same amount of protrusion as the annular protruding portion R2.

Figure 5:
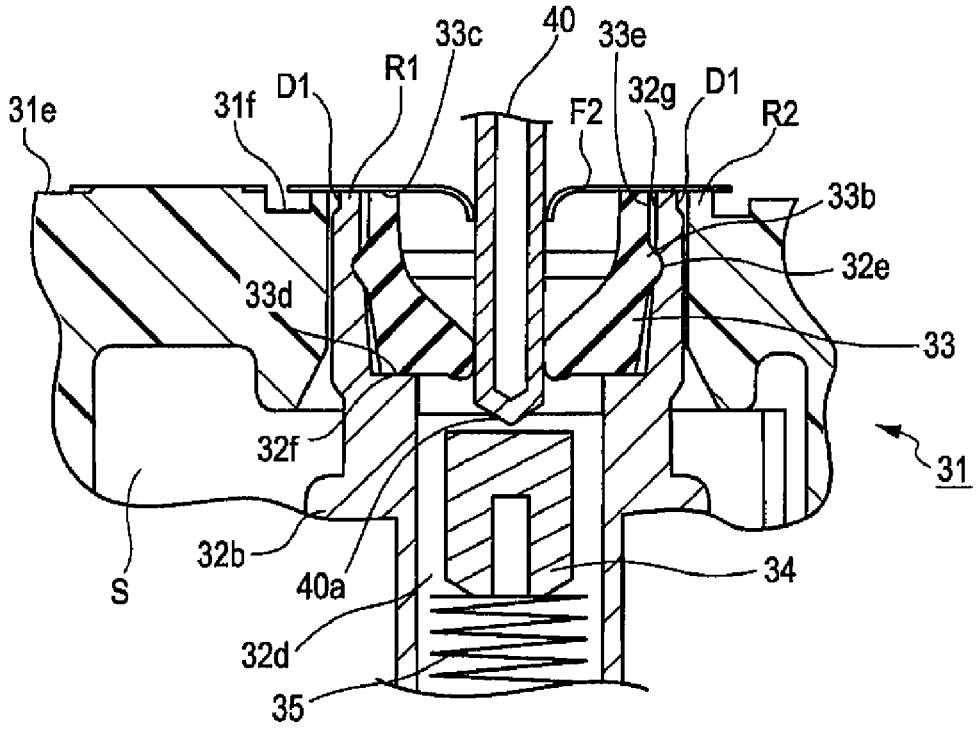
FIG. 5 is a partially sectional view of the ink cartridge in a state where an ink lead-out needle is inserted.

A pressure port H is formed on one side of the supply port anchoring portion 31*f*. The pressure port H communicates with the outside of the main body case 31*a* and the inside of the inner case 31*d*.

when the ink pack 32 is placed in the ink case 31, the ink pack 32 is placed in the inner case 31*d* such that the ink lead-out member 32*b* of the ink pack 32 is exposed outside from the inner side of the opening 31*g*. At this time, as shown in FIG. 5, the ink lead-out member 32*b* exposed from the opening 31*g* is placed such that a tip portion R1 exists at the same protrusion position as the annular protruding portion R2.

when the ink pack 32 is placed in the inner case 31*d*, the sealing film F1 (refer to FIG. 3) formed of polypropylene or polyethylene, for example, is heat welded to the inner case 31*d*.

Seal Structure

The sealing member 33 disposed inside the ink lead-out port 32*c* of the ink lead-out member 32*b* is formed of an elastic material, such as a thermoplastic elastomer. The sealing member 33 is an elastic ring of which upper and lower sides are opened with the approximately cylindrical shape. As shown in FIGS. 4 and 5, the inside of the sealing member 33 forms a funnel-shaped supply port 33*a* and elastically seals the outer periphery of the ink supply needle 40. In addition, ink contained in the ink bag 32*a* is supplied to the liquid ejecting apparatus by positioning a liquid inlet of the ink supply needle 40, which is inserted in the supply port 33*a*, within a passage 32*d* of the ink lead-out member 32*b*.

A recess 32*e* is formed on a side surface 32*g* of an inner wall that forms the ink lead-out port 32*c* of the ink lead-out member 32*b*. A protruding portion 33*b* that is in contact with the recess 32*e* is formed on an outer peripheral surface 33*e* of the sealing member 33. In the present embodiment, the position of the sealing member 33 is decided when the outer peripheral surfaces 33*e* and 33*d* of the sealing member 33 come in contact with the side surface 32*g* and a bottom surface 32*f* of the inner wall that forms the ink lead-out port 32*c* of the ink lead-out member 32*b*. That is, for the insertion direction of the ink supply needle 40, the position of the sealing member 33 is decided when the surface 33*d* of the sealing member 33 opposite the surface 33*c* being in contact with the sealing film F2 is made to come in contact with the bottom surface 32*f* of the inner wall that forms the ink lead-out port 32*c* of the ink lead-out member 32*b*. On the other hand, for the surface direction perpendicular to the insertion direction of the ink supply needle 40, the position of the sealing member 33 is decided when the protruding portion 33*b* formed on the outer peripheral surface 33*e* of the sealing member 33 is made to come in contact with the recess 32*e* formed on the side surface 32*g* of the inner wall of the ink lead-out port 32*c*.

In the present embodiment, the sealing film F2 is configured to be heat welded to a side of the supply port anchoring portion 31*f* of the ink case 31. Specifically, the sealing film F2 is heat welded to the tip portion R1 of the ink lead-out member 32*b*, an opening end surface of the sealing member 33, and the annular protruding portion R2 formed on an opening end surface of the opening 31*g* protruding outside from the supply port anchoring portion 31*f* and is also heat welded to each independent protruding portion R3 (refer to FIG. 3).

Here, since there is no material similarity between butyl rubber, which is a material of a known sealing member, and materials of the ink case 31 and ink lead-out member 32*b*, it was not possible to weld the sealing member to the ink case 31 and the ink lead-out member 32*b* and the sealing film F2 no matter which kind of material is selected for the sealing film F2.

The welding described above became possible by selecting a material of the sealing member 33. An example of a thermoplastic elastomer, which is a material of the sealing member 33, includes Munks (product name) made by Bridgestone, inc. (refer to JP-A-2002-225303), for example. It has been proved by experiments of the inventors that the sealing member 33 formed of the material was satisfactorily heat welded to polypropylene (PP), polyethylene (PE), erithropoietin (EPO), and the like that are polyolefine-based materials.

In the present embodiment, it is preferable that a material of the ink lead-out member 32*b* is the same as a material of the ink bag 32*a* from the fact that the ink lead-out member 32*b* is heat welded to the ink bag 32*a*. For this reason, in the present embodiment, the same material, such as polypropylene or polyethylene, is used for the ink bag 32*a*, the ink lead-out member 32*b*, and the ink case 31. If a material of the sealing film F2 is also polypropylene or polyethylene, the above-described welding can be realized.

Therefore, when the sealing film F2 is heat welded to the annular protruding portion R2, the tip portion R1 of the ink lead-out member 32*b*, and the sealing member 33, a gap D1 between the opening 31*g* and the ink lead-out member 32*b* and a gap D2 between the ink lead-out member 32*b* and the sealing member 33 are sealed by the sealing film F2.

As a result that the gap D2 is sealed with the sealing film F2, the recess 32*e* of the ink lead-out member 32*b* and the protruding portion 33*b* of the sealing member 33 function only for positioning of the sealing member 33, and liquid tight sealing may not be necessarily requested. In addition, from those described above, it can be understood that the configuration of the protruding portion 33*b* of the sealing member 33 or the recess 32*e* of the ink lead-out member 32*b* is not essential. That is, either one or both of the side surface 32*g* of the inner wall that forms the ink lead-out port 32*c* of the ink lead-out member 32*b* and the outer peripheral surface 33*e* of the sealing member 33 may be formed flat.

The following special effects can be obtained by sealing the gap D2 with the sealing film F2. For example, even if precision of roundness of the ink lead-out member 32*b* becomes worse and accordingly, the recess 32*e* and the protruding portion 33*b* are not completely sealed, ink never leaks through the gap D2. In addition, by pressing ink to supply the ink from the ink bag 32*a*, leakage of ink can be prevented by the sealing film F2 even if sealing of the recess 32*e* and the protruding portion 33*b* is broken. Furthermore, even if the ink cartridge 23 drops or vibration is applied to the ink cartridge 23, leakage of ink can also be prevented by the sealing film F2.

On the other hand, the following effects can be obtained by simultaneously sealing the gaps D1 with the sealing film F2.

A space S (refer to FIG. 3) formed by the sealing film F1 and the inner case 31*d* in which the ink pack 32 is placed is in a sealed state excluding the pressure port H. Therefore, air supplied from the pressure port H into the inner case 31*d* by the pressure pump 25 (refer to FIG. 1) supported on the frame 12 presses the ink pack 32 placed in the space S, since the inner case 31*d* is held airtight.

Furthermore, since the sealing film F2 is heat welded to the tip portion R1 of the ink lead-out member 32*b*, the ink lead-out port 32*c* of the ink lead-out member 32*b* is also sealed.

Accordingly, the inside of the ink pack is blocked from the outside. In addition, the sealing film F2 is heat welded to the annular protruding portion R2, thereby sealing the ink lead-out port 32*c* of the ink lead-out member 32*b*. Accordingly, there is no problem that the ink supply needle 40 is inserted from the outside to open the valve body 34 and as a result, bubbles are introduced into the ink pack 32. Furthermore, since the sealing film F2 is heat welded to the four independent protruding portions R3 surrounding the annular protruding portion R2, it is possible to prevent the sealing film F2 from being separated from the annular protruding portion R2 due to a certain force.

Furthermore, two ink lead-out member fixing ribs 31*j* are formed in the main body case 31*a* so that the ink lead-out member 32*b* is inserted. End portions 31*j*1 of the ink lead-out member fixing ribs 31*j* are in contact with an annular protruding portion 32*b*1 that is formed in the disk shape in the outer periphery of the ink lead-out member 32*b*, such that the ink lead-out member fixing ribs 31*j* are fixed to the main body case 31*a*. This regulates that the ink lead-out member 32*b* moves to the inside of the main body case 31*a* at the time of heat welding.

In addition, a rotation preventing member 31*k* is a protruding portion engaging with a recess (not shown) formed in the annular protruding portion 32*b*1 of the ink lead-out member 32*b* and serves to position the ink pack 32 at the predetermined location by regulating the movement of the ink pack 32 in the rotational direction thereof.

Another Example of the Ink Lead-Out Member

Figure 6:
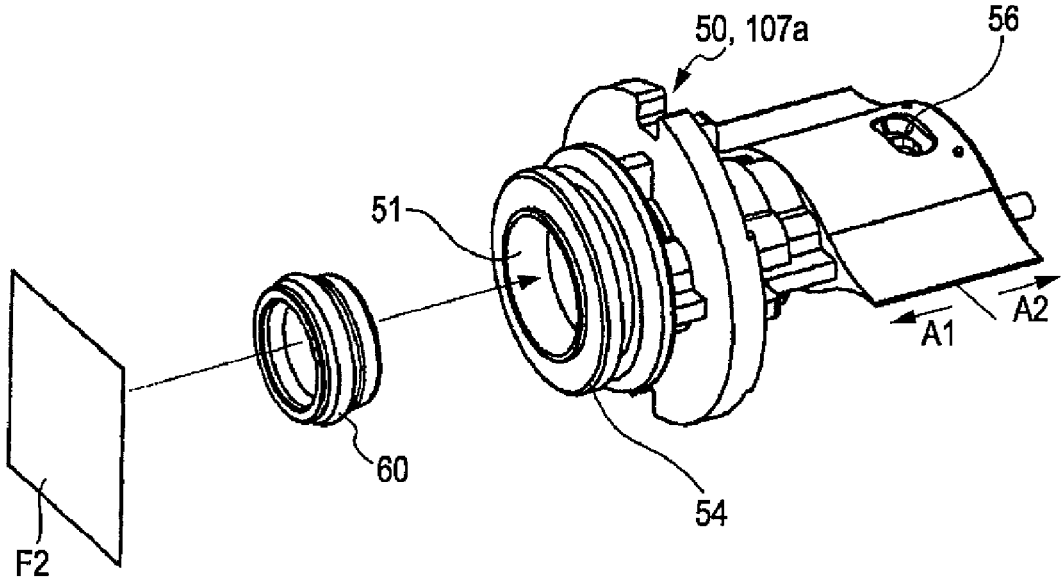
FIG. 6 is an exploded perspective view illustrating another example of the seal structure.

FIG. 6 is an exploded perspective view illustrating an ink lead-out member 50 different from that in the first embodiment. The ink lead-out member 50 shown in FIG. 6 has a different outer shape from the ink lead-out member 32*b* in the first embodiment. Furthermore, in the present embodiment, the sealing film F2 is not welded to an ink case but is welded only to an ink lead-out port 51 and a sealing member 60. The present embodiment is different from the first embodiment only in this point and the other points are the same as those described in the first embodiment.

Figure 7:
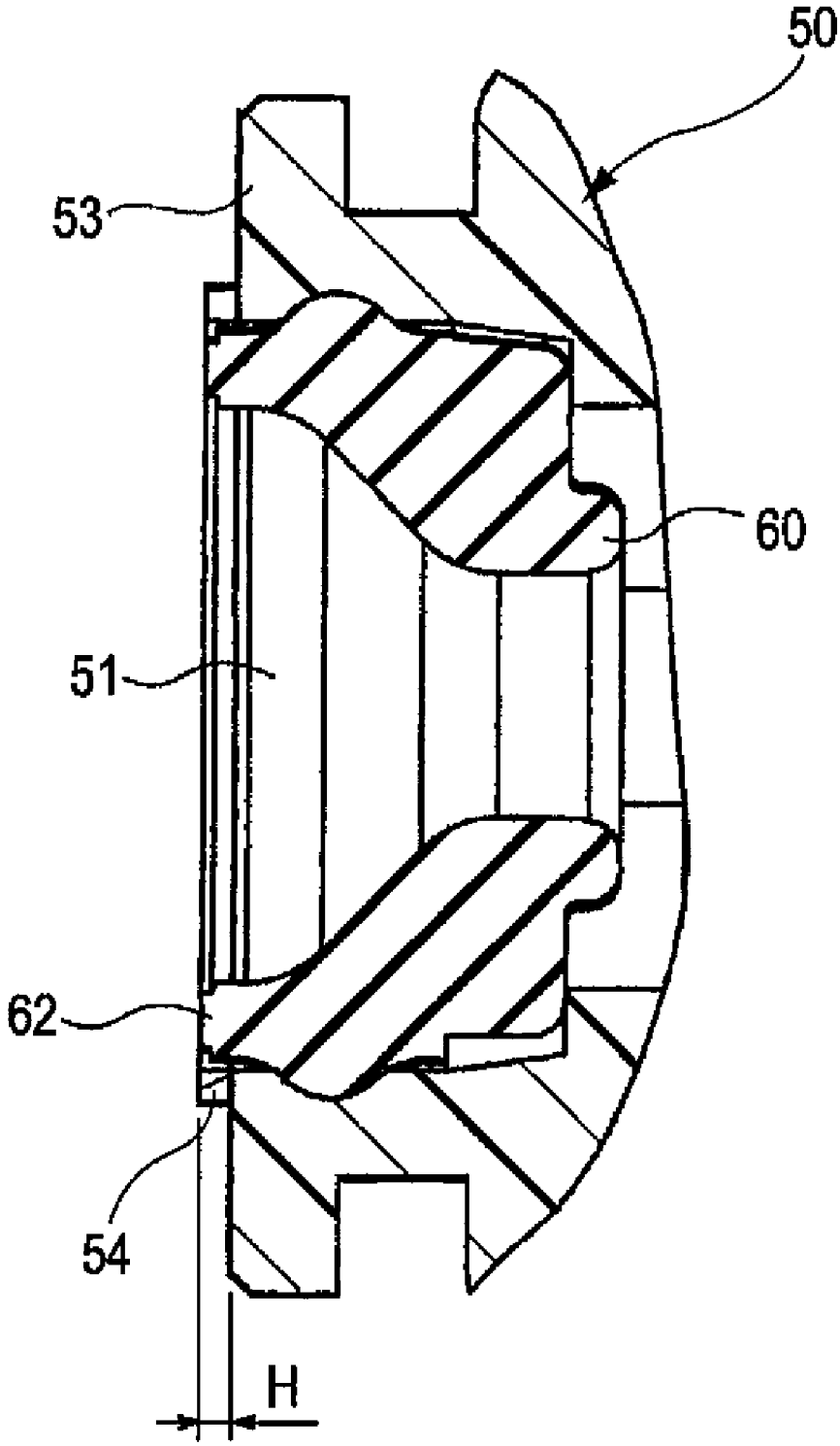
FIG. 7 is a cross-sectional view illustrating a state before a sealing film is welded in the seal structure shown in FIG. 6.

FIG. 7 shows a state in which the sealing member 60 is inserted in the ink lead-out port 51 and is a partially sectional view illustrating a state before the sealing film F2 is heat welded.

The ink lead-out member 50 has a first annular welding margin portion 54 that protrudes by the height H from an opening end surface 53. Similarly, the sealing member 60 is in a state inserted in the ink lead-out port 51 and has a second annular welding margin portion 62 that protrudes by the height H from the opening end surface 53 of the ink lead-out member 50. That is, the first and second welding margin portions 54 and 62 are positioned on the same plane.

After the state shown in FIG. 7 is set, the sealing film F2 is placed on the first and second welding margin portions 54 and 62 and the sealing film F2 is welded by heat and pressure. At this time, the first and second welding margin portions 54 and 62 melt and at the same time, are unified with the welded sealing film F2 to be then welded. After welding, the sealing film F2 is supported on the same plane as the opening end surface 53 since the first and second welding margin portions 54 and 62 are in a melted state.

Thus, by forming the first and second welding margin portions 54 and 62 to protrude in the annular shape, welding places become limited. As a result, welding can be completed in relatively low pressure and short time. In addition, by performing welding until the first and second welding margin portions 54 and 62 are removed, it can be visually checked whether or not welding has been completed. Accordingly, occurrence of poor welding can be reduced.

Also in the present embodiment, a place equivalent to the gap D2 shown in FIG. 4 can be sealed and leakage of ink can be prevented, which is the same as in the first embodiment. Therefore, according to the present embodiment, all effects in the first embodiment can be obtained except for the effect obtained by sealing the gap D1. In addition, the changes described in the first embodiment may also be applied to the present embodiment except for blocking or covering the gap D1. In addition, the first and second welding margin portions 54 and 62 shown in FIG. 7 may also be applied to the first embodiment.

Another Example of the Ink Cartridge

Figure 8:
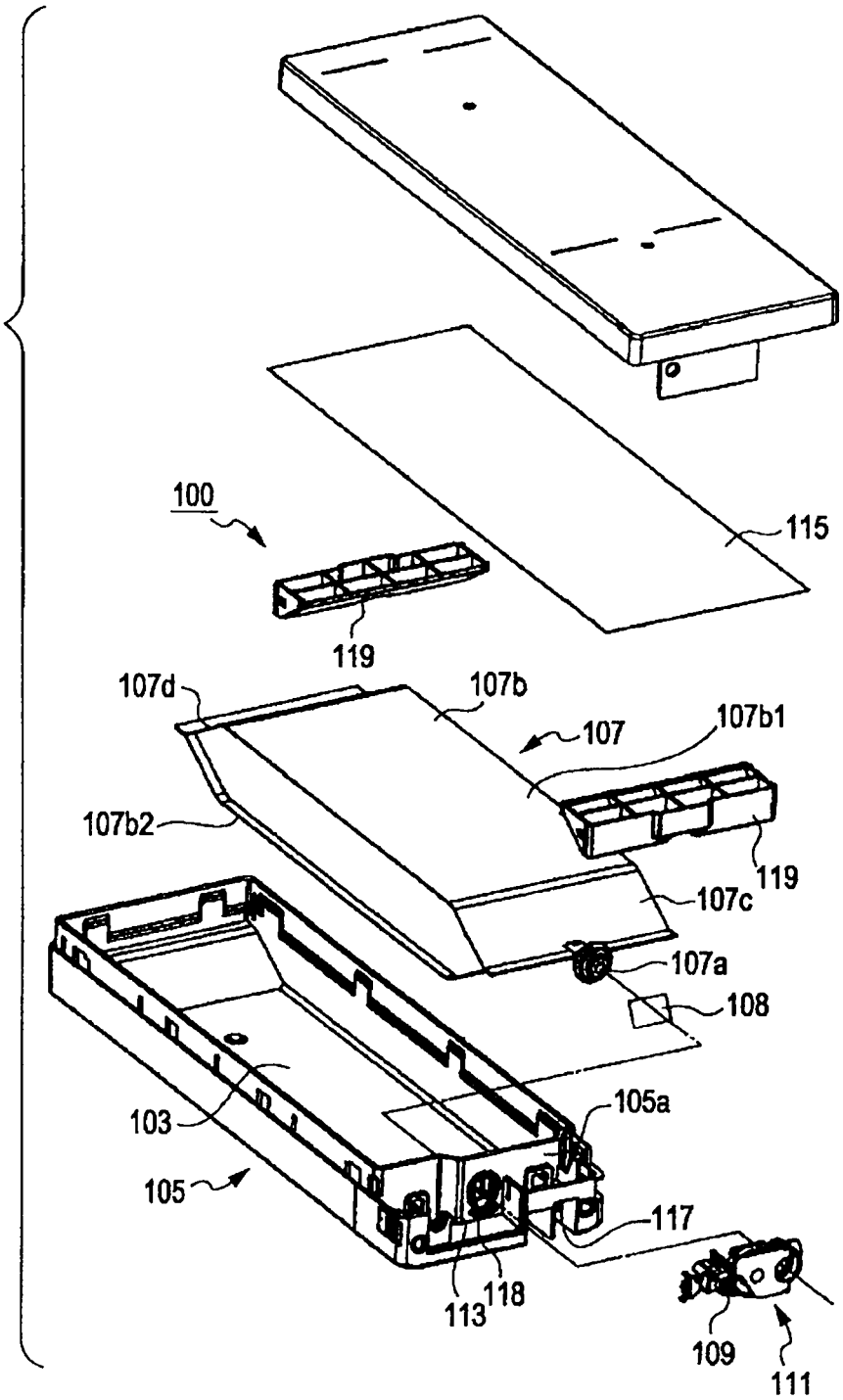
FIG. 8 is an exploded perspective view illustrating another example of the ink cartridge having the seal structure shown in FIG. 6.

FIG. 8 illustrates an ink cartridge 100 that is of a different type from that shown in FIG. 3 and that uses an ink lead-out member 107*a* having the same structure as the ink lead-out member shown in FIG. 6 and FIG. 7. This ink cartridge 100 may also be mounted in the same liquid ejecting apparatus as that described in the above embodiment. Accordingly, a detailed explanation on the liquid ejecting apparatus will be omitted. Moreover, in the subsequent description, ink may be expressed as liquid or liquid may be expressed as ink.

The ink cartridge 100 shown in FIG. 8 is detachably mounted in a cartridge mounting portion of an ink jet recording apparatus for commercial use and supplies ink to a recording head (liquid ejecting head) provided in the recording apparatus.

The ink cartridge 100 includes: a container body 105 in which a bag accommodating portion 103 pressed by a pressure unit is separately formed; an ink pack 107 serving as a fluid container which stores ink therein, is accommodated in the bag accommodating portion 103, and discharges stored ink from an ink lead-out member (fluid lead-out portion) 107*a* by pressure of the bag accommodating portion 103; and a remaining liquid amount detecting unit 111 that has a liquid lead-out member 109 serving to supply ink to a recording head, which is an external liquid consuming apparatus, and is detachably mounted in the container body 105.

The container body 105 is a housing formed by resin molding. In the container body 105, the approximately box-shaped bag accommodating portion 103 whose upper part is opened and a detecting unit accommodating portion 113, which is located on a front surface side of the bag accommodating portion 103 and accommodates the remaining liquid amount detecting unit 111 therein, are formed so as to be separated from each other.

An open surface of the bag accommodating portion 103 is sealed with a sealing film 115 after the ink pack 107 is accommodated in the bag accommodating portion 103. Thus, the bag accommodating portion 103 becomes a sealed chamber.

A pressure port 117 serving as a communicating path used to apply pressure air to the inside of the bag accommodating portion 103, which is formed as a sealed chamber by the sealing film 115, is provided in a partition wall 105*a* which separates the bag accommodating portion 103 from the detecting unit accommodating portion 113. When the ink cartridge 100 is mounted in the cartridge mounting portion of the ink jet recording apparatus, a pressure air supplying portion on a side of the cartridge mounting portion is connected to the pressure port 117. Accordingly, it becomes possible to press the ink pack 107 with the pressure air supplied to the inside of the bag accommodating portion 103.

The ink pack 107 is obtained by bonding the cylindrical ink lead-out member 107*a*, to which a connection pin (not shown) of the remaining liquid amount detecting unit 111 is inserted and connected, to one end of a flexible bag 107*b* formed of a sealing film.

The ink lead-out member 107*a* of the ink pack 107 is airtight inserted through an opening 118 for insertion of a connection port, which is formed on the partition wall 105*a*, such that the tip thereof protrudes to the inside of the detecting unit accommodating portion 113. A sealing film 108 is heat welded to the ink lead-out member 107*a*.

In addition, when the ink pack 107 is mounted in the bag accommodating portion 103, a resin member 119 is mounted on inclined portions 107*c* and 107*d* positioned at front and rear sides of the flexible bag 107*b*. The resin member 119 prevents the ink pack 107 from wobbling within a sealed chamber when a top surface of the bag accommodating portion 103 is covered with the sealing film 115 such that the bag accommodating portion 103 becomes the sealed chamber, and at the same time, improves pressure efficiency when pressing the inside of the bag accommodating portion 103 with pressure air by embedding a superfluous empty space in the sealed chamber.

Figure 9:
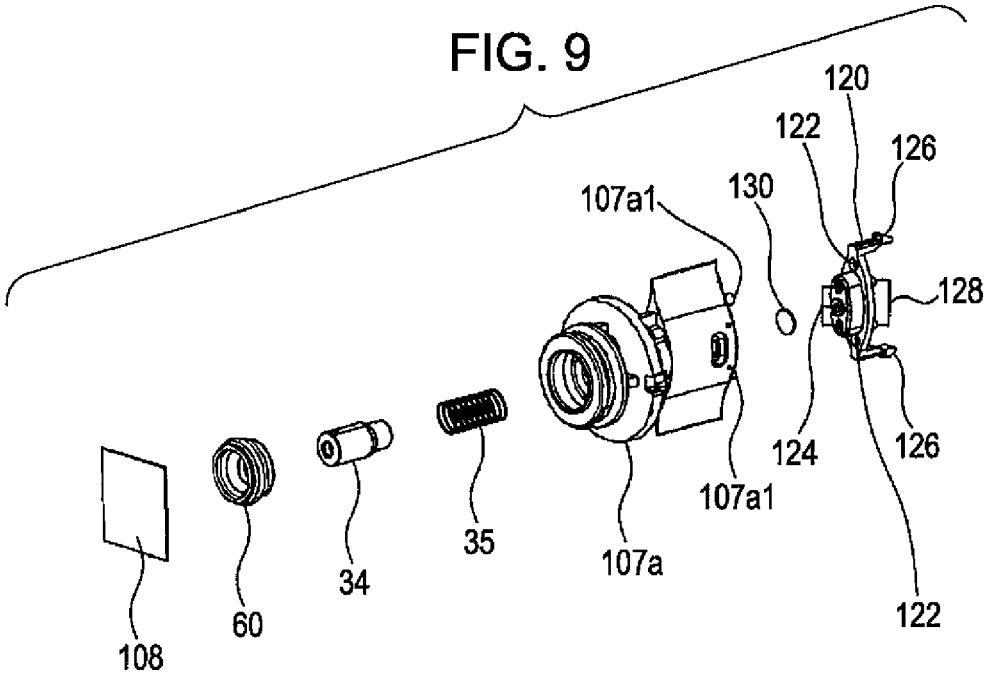
FIG. 9 is an exploded perspective view illustrating an ink lead-out member and a check valve lid member attached to a rear end of the ink lead-out member.

FIG. 9 is an exploded perspective view illustrating the ink lead-out member 107*a* and a check valve lid member 120 attached to a rear end of the ink lead-out member 107*a*. Referring to FIG. 9, the valve body 34 and the spring member 35 (refer to FIG. 5), which form a valve mechanism, and the sealing member 60 are inserted in one end of a passage of the ink lead-out member 107*a* and an opening end thereof is sealed with the sealing film 108. A check valve 130 is inserted in the other end of the passage of the ink lead-out member 107*a*. In order to prevent the check valve 130 from being separated from the ink lead-out member 107*a*, the check valve lid member 120 is connected to the other end of the flow passage of the ink lead-out member 107*a*. The check valve 130 can move within the ink passage and serves to prevent back flow of ink when the ink returns to the ink pack 107. However, the check valve 130 does not completely block a return passage (or a filling passage of ink) of ink.

On the other end of the ink lead-out member 107*a*, for example, two bosses 107*a*1 are formed and are inserted in two holes 122 formed in the check valve lid member 120. A tip of the boss 107*a*1 protruding from the hole 122 is fastened by heat such that the ink lead-out member 107*a* and the check valve lid member 120 are unified. In addition, the check valve lid member 120 is formed with, for example, three holes 124 communicating with the passage of the ink lead-out member 107*a*. In addition, the check valve lid member 120 is formed with a claw member 126 and a stopper 128 that are locked members.

Structure of a Spacer Member

Figure 10:
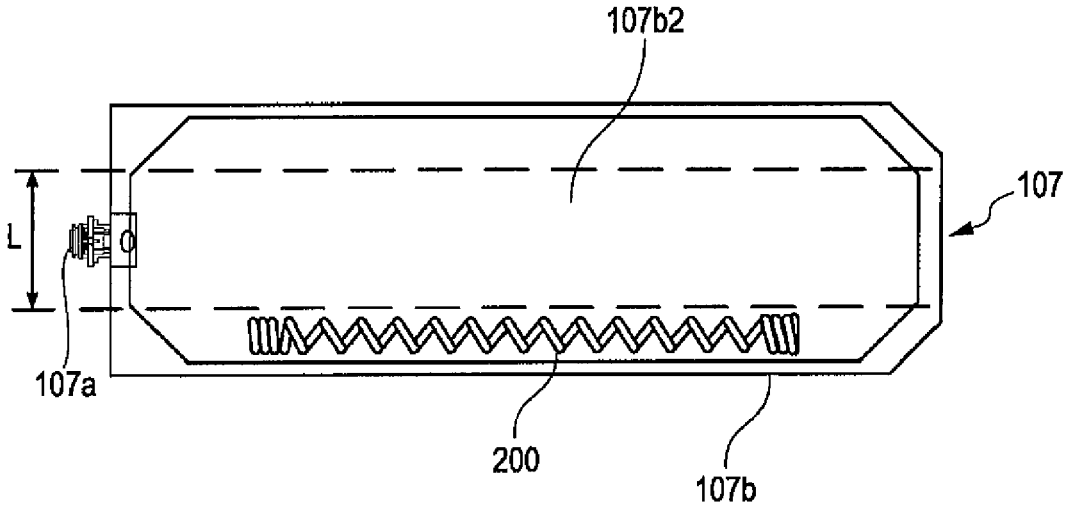
FIG. 10 is a view illustrating an ink pack having a spacer member according to the first embodiment of the invention.
Figure 11A:
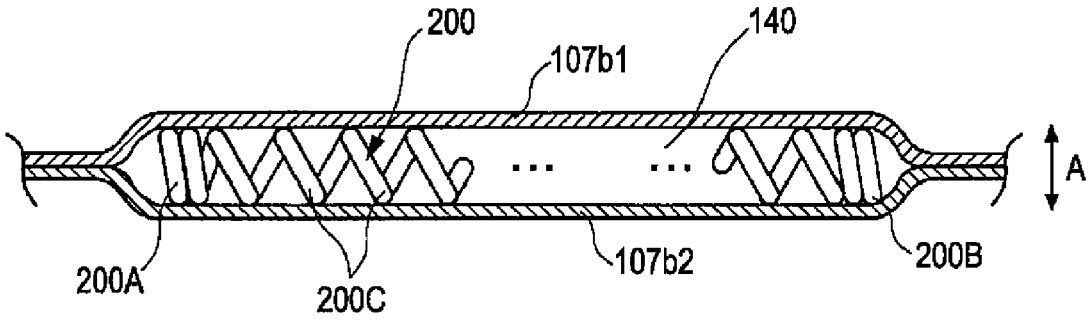
FIG. 11A is a view illustrating a spacer member that is in contact between inner wall surfaces of the two flexible films.
Figure 11B:
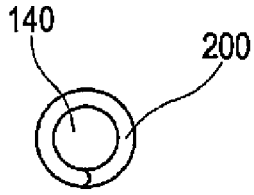
FIG. 11B is a side surface view illustrating the spacer member.

FIG. 10 is a view illustrating an ink pack having a spacer member according to the first embodiment of the invention, FIG. 11A is a view illustrating a remaining ink space formed by bringing a spacer member and two flexible films into contact with each other, and FIG. 11B is a side surface view illustrating a spacer member. In addition, FIG. 10 illustrates a state where the top-surface-side flexible film 107*b*1 of the flexible films, which form the flexible bag 107*b* shown in FIG. 8, is removed and an inner wall surface of the bottom-surface-side flexible film 107*b*2 is exposed.

In FIG. 10, a state where the ink cartridge 100 (23) is mounted in a printer is shown. The spacer member 200 is disposed at a lower side of the flexible bag 107*b*, which forms the ink pack 107, in the gravity direction. For this reason, the spacer member 200 is formed of a material, such as metal or resin, which has larger specific gravity than ink. In the case where contained liquid is ink, it is preferable that the spacer member 200 be formed of a material which does not melt in ink composition and does not precipitate foreign matters. An example of the material that does not melt in ink composition includes stainless steel SUS304 in the case of a metal. In the case where the spacer member 200 is formed of a resin, many materials that do not melt in ink composition have smaller specific gravity than ink. For example, polyethylene terephthalate (PET) is a candidate of a material of the spacer member 200 because the specific gravity of polyethylene terephthalate (PET) is larger than ink. In addition, a highly reliable resin, such as polyethylene and polypropylene, can be used as a resin material that does not melt in ink composition. In this case, however, a weight member that is connected to the spacer member 200 and serves to dispose the spacer member 200 at the lower side in the gravity direction within the flexible bag 107*b*.

Next, the spacer member 200 will be described with reference to FIGS. 11A and 11B. FIG. 11A illustrates a state where the ink pack 107 deforms in the direction, in which inner wall surfaces of the two flexible films 107*b*1 and 107*b*2 of the ink pack 107 facing each other in the direction indicated by arrow A come close to each other, at the time of reduction in the amount of remaining ink as ink in the ink pack 107 is taken out through the ink lead-out member 107*a*. The spacer member 200 is formed, in the shape of a coil spring, as a contact regulating member that forms a remaining ink space 140, in which liquid remains, by regulating contact between parts of the inner wall surfaces of the two flexible films 107*b*1 and 107*b*2 facing each other at the time of reduction in the amount of remaining ink. In both end portions 200A and 200B of the spacer member 200, a plurality of turns are in contact with each other, such that the end portions are not entangled even if the other spacer members 200 further exist. However, in a region excluding both end portions of the spacer member 200, a gap is formed between adjacent turns 200C. Accordingly, the spacer member 200 allows ink to flow inside or outside a remaining ink liquid space through the gap between the turns 200C in addition to a hole of an end portion shown in FIG. 11B.

Operation of a Spacer Member

As described above, when the ink cartridge 100 (23) is mounted in the printer, the ink pack 107 (32) is deformed by pressure due to pressure air supplied from the pressure pump and then ink in the ink pack 107 (32) is taken out through the ink lead-out member 107*a* (32*b*).

FIG. 10 shows a state of the ink cartridge 100 attached to the printer, and the ink in the ink pack 107 shown in FIG. 10 tends to be taken out in the order of an upper region, a middle region, and a lower region. This is because ink in the lower ink pack region, which is a lower part in the gravity direction, tends to be taken out last.

On the other hand, for example, in the case of pigment ink in which a pigment used as coloring matter is dispersed in an ink solvent, the specific gravity of the pigment is larger than that of the ink solvent. Accordingly, the pigment tends to sediment in the lower region of the ink pack 107.

For this reason, the pigment ink taken out last from the ink pack 107 has a pigment concentration increased by the pigment that sediments. Discharge of such ink leads to a trouble of an apparatus or concentration unevenness at the time of printing. The amount of the ink with a high concentration is about several percent of the whole ink contained in the ink pack 107.

Therefore, in the present embodiment, ink that remains in the ink pack 107 to the last is contained in the remaining ink space 140 formed by the spacer member 200 between the two flexible films 107*b*1 and 107*b*2 facing each other, as shown in FIG. 11A. When the two flexible films 107*b*1 and 107*b*2 facing each other are brought into contact with each other except for the remaining ink space 140, the ink pack 107 does not deform any more even if pressure air from the pressure pump is supplied around the ink pack 107. As a result, the ink in the remaining ink space 140 cannot be taken out. Alternatively, the end of ink may be detected at timing when ink remains in the remaining ink space 140 by using a remaining amount sensor, for example, so that ink in the remaining ink space 140 is not taken out.

Here, before the two flexible films 107*b*1 and 107*b*2 facing each other start to come in contact with the spacer member 200, ink is taken outside the ink pack 107 by the pressure from the pressure pump regardless of existence of the spacer member 200. Since the two flexible films 107*b*1 and 107*b*2 facing each other are not in contact with the spacer member 200, input/output of ink to/from the spacer member 200 is completely free, which does not generate any resistive force against discharge of ink.

Even after the two flexible films 107*b*1 and 107*b*2 facing each other are brought into contact with the spacer member 200, input/output of ink to/from the remaining ink space 140 is free. Therefore, ink with high concentration, which sediments in the lower region within the ink pack 107, particularly in the neighborhood of the ink end can also be free to move into the spacer member 200.

As described above, ink corresponding to several percent of volume that sediments in the lower region of the ink pack 107 is introduced into the remaining ink space 140 within the spacer member 200 disposed in the lower region of the ink pack 107 in the neighborhood of the ink end before the remaining ink amount sensor detects the ink end and is held in the remaining ink space 140 at the time of ink detection.

Actually, according to the experiments of the inventors, the quality of a printed matter was maintained uniformly by causing ink held in the remaining ink space 140 not to be taken out at the time of ink end detection. As a result, any trouble in the apparatus did not occur.

Method of Manufacturing an Ink Pack (Including an Ink Filling Method)

The flexible bag 107*b* shown in FIG. 8 is opened over a range narrower than the middle width L of the front edge shown in FIG. 10 and the flexible films are welded in the other sides, such that the flexible bag 107*b* is delivered in the bag shape. First, as shown in FIG. 10, the spacer member 200 is inserted into the flexible bag 107*b* through the opening of the width L, thereby being supplied to the inside. Then, the ink lead-out member 107*a* and the check valve lid member 120 are inserted into the flexible bag 107*b* through the opening of the width L.

Then, a region, which is indicated by arrow A1, of the opening of the width L not including a bypass passage 56 of the ink lead-out member 107*a* shown in FIG. 6 is welded to the flexible films 107*b*1 and 107*b*2, such that the ink lead-out member 107*a* is temporarily fixed to the flexible bag 107*b*.

Figure 12A:
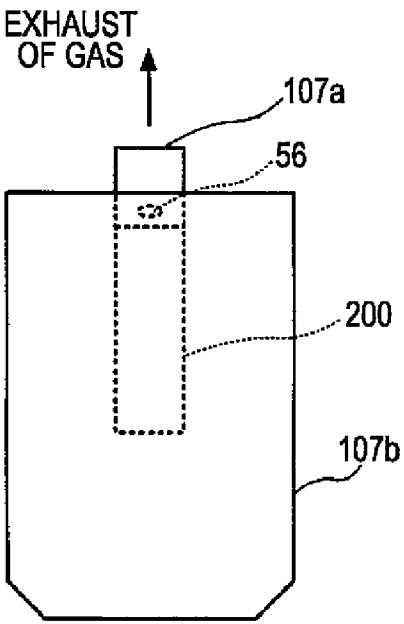
FIG. 12A is a view illustrating an exhaust process in an ink pack.

Then, as shown in FIG. 12A, the spacer member 200 is disposed at the position facing the ink lead-out member 107*a* within the flexible bag 107*b* and gas is sucked to exhaust the flexible bag 107*b*. For this reason, as shown in FIG. 5, the valve body 34 is pressed against the biasing force of the spring member 35 to thereby open the valve. This exhaust is performed through the bypass passage 56 that is opened in addition to passages of the ink lead-out member 107*a*, the check valve lid member 120, and the spacer member 200. At this time, the two flexible films 107*b*1 and 107*b*2 facing each other are in contact with the spacer member 200, as shown in FIG. 11A. Therefore, in a region excluding the region of the spacer member 200, the two flexible films 107*b*1 and 107*b*2 facing each other are in direct contact with each other, such that air does not remain. By this exhaust, contact between parts of inner wall surfaces of the two flexible films 107*b*1 and 107*b*2 facing each other is regulated by the spacer member 200, and the space 140 (not ink but air remains) is formed in the spacer member 200

Figure 12B:
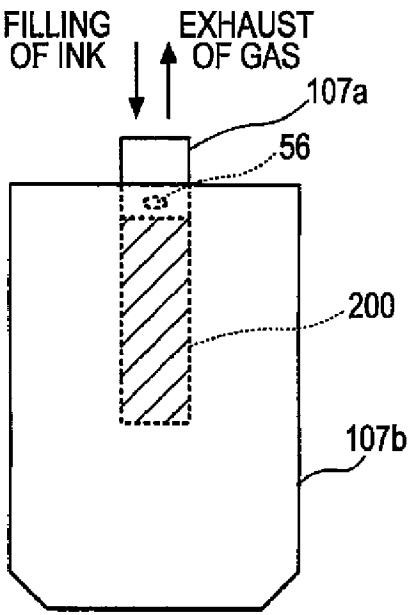
FIG. 12B is a view illustrating an exhaust process in a spacer member.

Then, as shown in FIG. 12B, ink is filled into the space 140 in a state where the ink lead-out member 107*a* faces an upper side in the gravity direction. This ink filling is performed through the bypass passage 56 that is opened in addition to passages (using incomplete blocking of the check valve 130) of the ink lead-out member 107*a*, the check valve lid member 120, and the spacer member 200. The air in the space 140 is pushed upward by the ink filling and is then exhausting again and accordingly, the air in the space 140 is finally discharged outside. As a result, the whole air in the flexible bag 107*b* is discharged.

If printing is executed in a state where $N_2$ and $O_2$ are dissolved a lot in ink within the ink cartridge 100 (23) bubbles may be generated in ink by the pressure change at the time of ink discharge. When bubbles are thus generated in ink, discharge failure occurs due to clogging of ink passage caused by the bubbles, which may deteriorate the printing quality. Such a trouble can be reduced in the present embodiment.

Figure 12C:
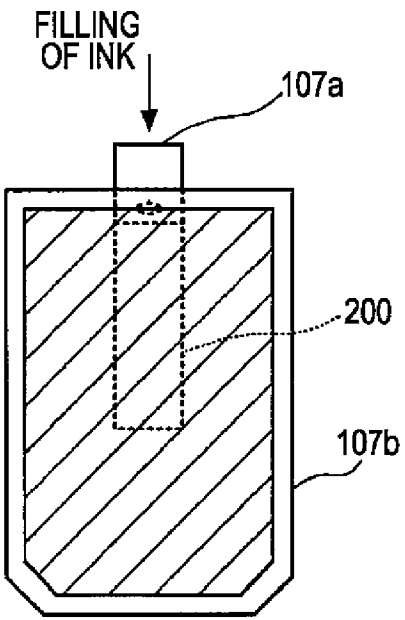
FIG. 12C is a view illustrating a process of filling ink into an ink pack.

Then, as shown in FIG. 12C, a predetermined amount of ink is filled into the flexible bag 107*b*, completing the ink filling. At this time, the spacer member 200 sediments to the lower part of the flexible bag 107*b* in the gravity direction due to its weight, as shown in FIG. 10.

Finally, a region, which is indicated by arrow A2, including the bypass passage 56 of the ink lead-out member 107*a* shown in FIG. 6 is heat welded to the flexible films 107*b*1 and 107*b*2, such that the ink lead-out member 107*a* is fixed to the flexible bag 107*b*.

Ink Refilling Method

Next, a liquid refilling method of refilling ink into the ink cartridge 100 (23) in a state the ink cartridge 100 (23) is recovered from the market after ink in the ink cartridge 100 (23) is taken out will be described. In the case of the ink cartridge 100 shown in FIG. 8, it is preferable to perform refilling after detaching the remaining liquid amount detecting unit 111.

Figure 13:
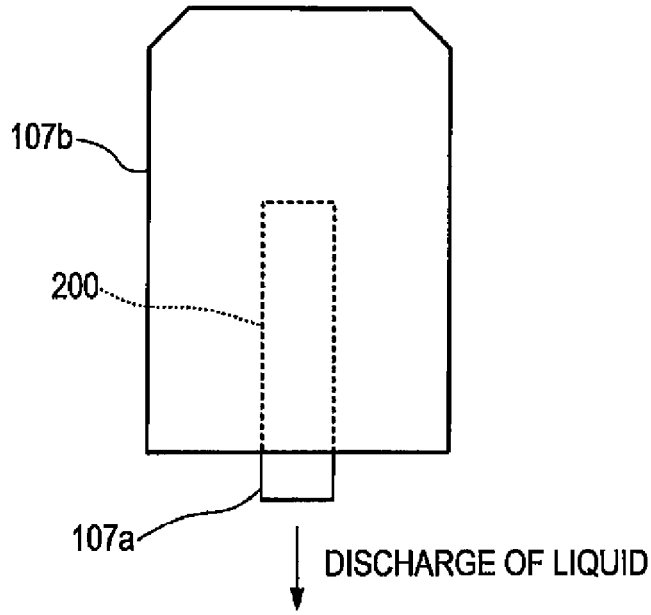
FIG. 13 is a view illustrating a process of taking out remaining ink in a spacer member before ink refilling.

First, as shown in FIG. 13, the ink lead-out member 107*a* is disposed at the lower side in the gravity direction, and the spacer member 200 is disposed opposite the ink lead-out member 107*a*, for example. In this state, the valve body 34 and the spring member 35 that form the valve mechanism in the ink lead-out member 107*a* are opened to thereby discharge the ink remaining in the remaining ink space 140. As a result, a state of the ink pack 107 becomes the same as the state before the exhaust process shown in FIG. 12A. Thereafter, if necessary, a process (refer to FIG. 12A) of exhausting air by sucking the air within the ink pack 107, a process (refer to FIG. 12B) of injecting a predetermined amount of ink (a small amount of ink is sufficient) into the space 140 formed in the spacer member 200 in a state where the ink lead-out member 107*a* faces upward in the gravity direction and then exhausting air by sucking the air from the space 140 in the spacer member 200, and a process (refer to FIG. 12C) of refilling ink into the ink pack 107 may be executed.

Second Embodiment

Structure of a Spacer Member

Figure 14:
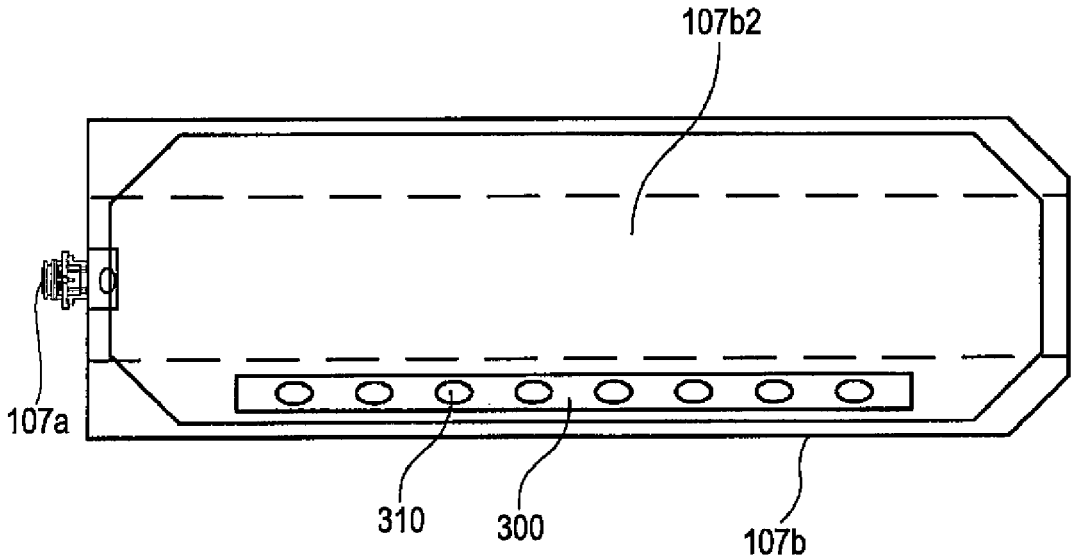
FIG. 14 is a view illustrating an ink pack having a spacer member according to a second embodiment of the invention.
Figure 15A:
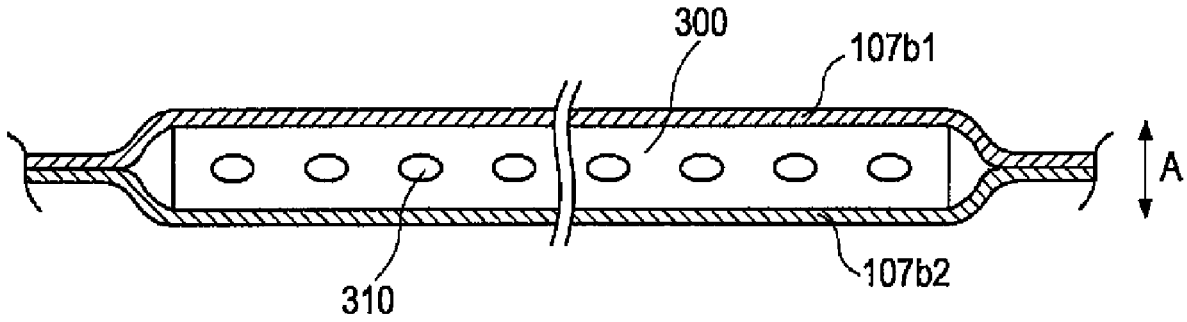
FIG. 15A is a longitudinal sectional view illustrating a spacer member that is in contact between inner wall surfaces of two flexible films.
Figure 15B:
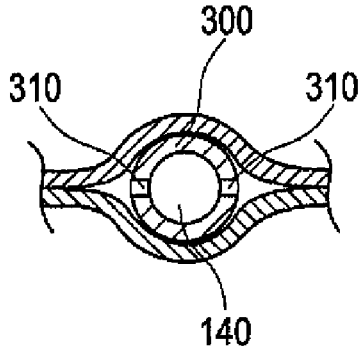
FIG. 15B is a lateral sectional view illustrating the spacer member that is in contact between the inner wall surfaces of the two flexible films.

In the present embodiment, the spacer member 200 shown in FIGS. 10, 11A, and 11B in the first embodiment are replaced with a spacer member 300 shown in FIGS. 14, 15A, and 15B. In FIGS. 14, 15A, and 15B, the spacer member 300 is formed as a contact regulating member in which a plurality of holes 310 are formed on a cylindrical peripheral surface so as to penetrate the surface. In addition, as shown in FIG. 14, this spacer member 300 is also disposed in a lower part of the flexible bag 107*b* in the gravity direction due to its weight.

Operation of a Spacer Member

Also in the present embodiment, ink that remains in the ink pack 107 to the last is contained in the remaining ink space 140 formed by the spacer member 300 between the two flexible films 107*b*1 and 107*b*2 facing each other, as shown in FIG. 15A. When the two flexible films 107*b*1 and 107*b*2 facing each other are brought into contact with each other except for the remaining ink space 140, the ink pack 107 does not deform any more even if pressure air from the pressure pump is supplied around the ink pack 107. As a result, the ink in the remaining ink space 140 cannot be taken out. Alternatively, the end of ink may be detected at timing when ink remains in the remaining ink space 140 by using a remaining amount sensor, for example, so that ink in the remaining ink space 140 is not taken out.

Here, before the two flexible films 107*b*1 and 107*b*2 facing each other start to come in contact with the spacer member 300, ink is taken outside the ink pack 107 by the pressure from the pressure pump regardless of existence of the spacer member 300. This is because input/output of ink to/from the spacer member 300 is completely freely performed through openings formed at both ends of the cylindrical portion and through the holes 310 formed on the cylindrical peripheral surface since the two flexible films 107*b*1 and 107*b*2 facing each other are not in contact with the spacer member 300.

Even after the two flexible films 107*b*1 and 107*b*2 facing each other are brought into contact with the spacer member 300, input/output of ink to/from the remaining ink space 140 is free. Here, in both end portions of the spacer member 300 in the longitudinal direction shown in FIG. 15A and a sectional surface shown in FIG. 15B, contact between the flexible films 107*b*1 and 107*b*2 are not good only with surrounding pressure. For this reason, through the openings on both end sides of the spacer member 300 and the holes 310 on the peripheral surface, ink is made to flow inside or outside the remaining ink space 140. As a result, ink with high concentration, which sediments in the lower region within the ink pack 107, particularly in the neighborhood of the ink end can also be free to move into the spacer member 300.

As described above, ink corresponding to several percent of volume that sediments in the lower region of the ink pack 107 is introduced into the remaining ink space 140 within the spacer member 300 in the neighborhood of the ink end before the remaining ink amount sensor detects the ink end and is held in the remaining ink space 140 at the time of ink detection.

Actually, according to the experiments of the inventors, the quality of a printed matter was maintained uniformly by causing ink held in the remaining ink space 140 not to be taken out at the time of ink end detection. As a result, any trouble in the apparatus did not occur.

Third Embodiment

In the present embodiment, the spacer member 200 as the contact regulating member disposed in the lower part of the flexible bag 107*b* in the gravity direction in the first embodiment is replaced with a spacer member 400 extending on a straight line of a passage of an ink lead-out member 107*a*. Accordingly, since the present embodiment is the same as the first embodiment except for the structure and operation of the spacer member, an explanation on the same parts will be omitted. In addition, a member having the same function as in the first embodiment is denoted by the same reference numeral, and a detailed explanation thereof will be omitted or made simple.

Structure of a Spacer Member

Figure 16:
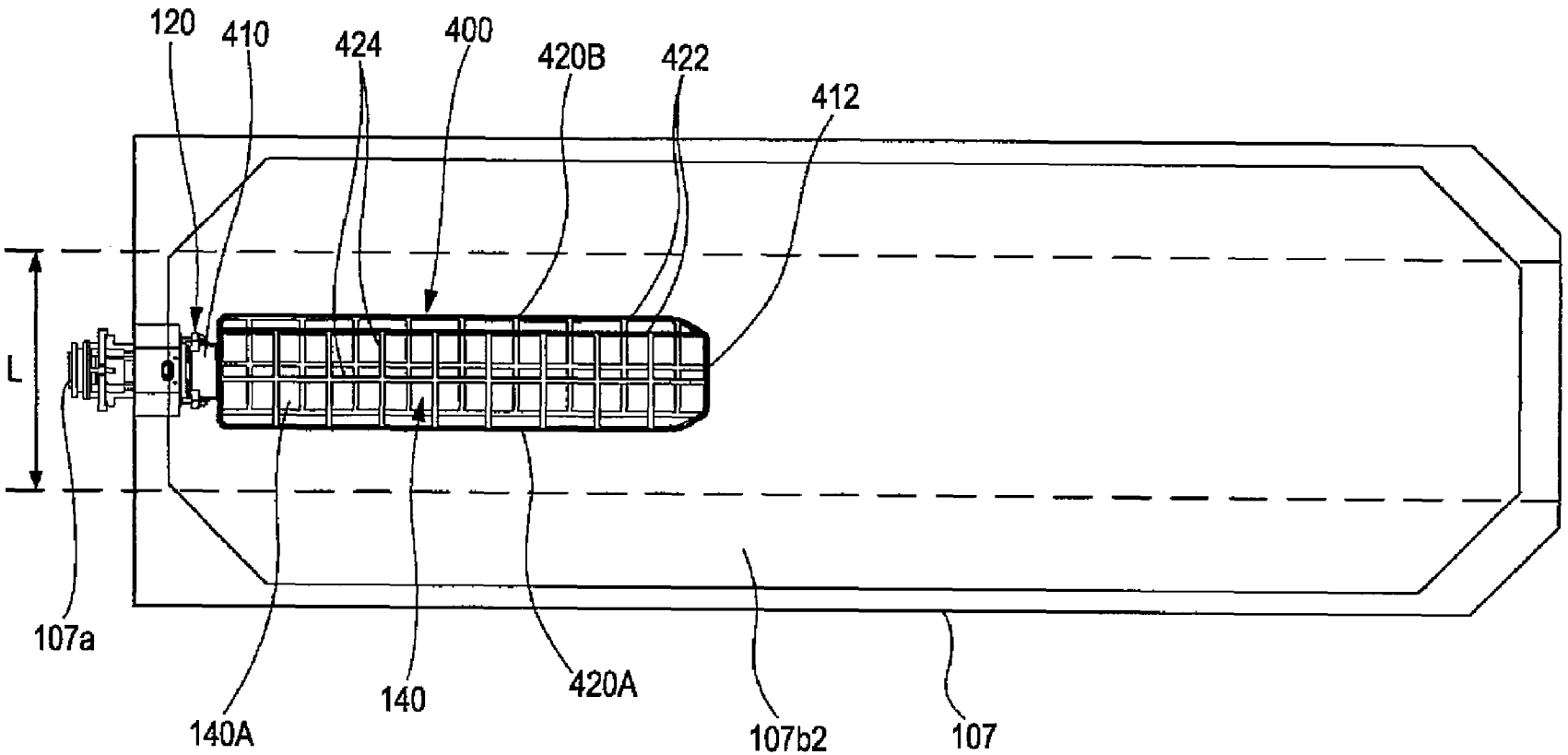
FIG. 16 is a view illustrating an ink pack having a spacer member according to a third embodiment of the invention.
Figure 17:
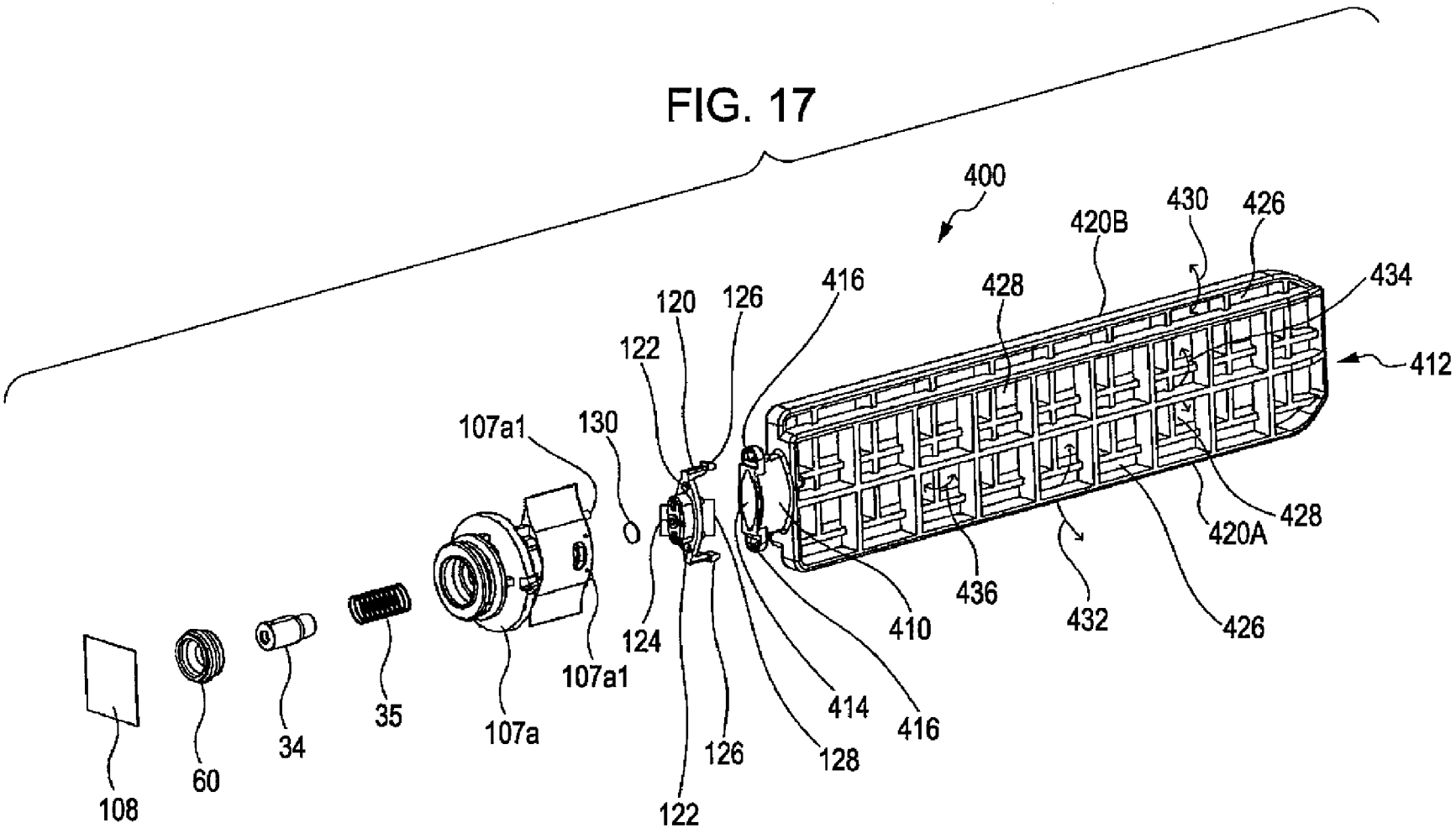
FIG. 17 is an exploded perspective view illustrating a state where the spacer member according to the third embodiment of the invention is connected to the ink lead-out member.

FIG. 16 is a view illustrating a spacer member 400 according to the third embodiment, which is connected to the ink lead-out member 107*a* shown in FIG. 9 and is disposed within the ink pack 107, and FIG. 17 is an exploded perspective view illustrating a state where the spacer member 400 is connected to the ink lead-out member 107*a* through the check valve lid member 120. In addition, FIGS. 18A to 18D illustrate the spacer member 400 according to the third embodiment. In addition, FIG. 16 illustrates a state where the top-surface-side flexible film 107*b*1 of the flexible films, which form the flexible bag 107*b* shown in FIG. 8, is removed and an inner wall surface of the bottom-surface-side flexible film 107*b*2 is exposed.

First, the spacer member 400 will be described with reference to FIGS. 18A to 18D and 17.

Figures 18A, 18B, 18C, 18D:
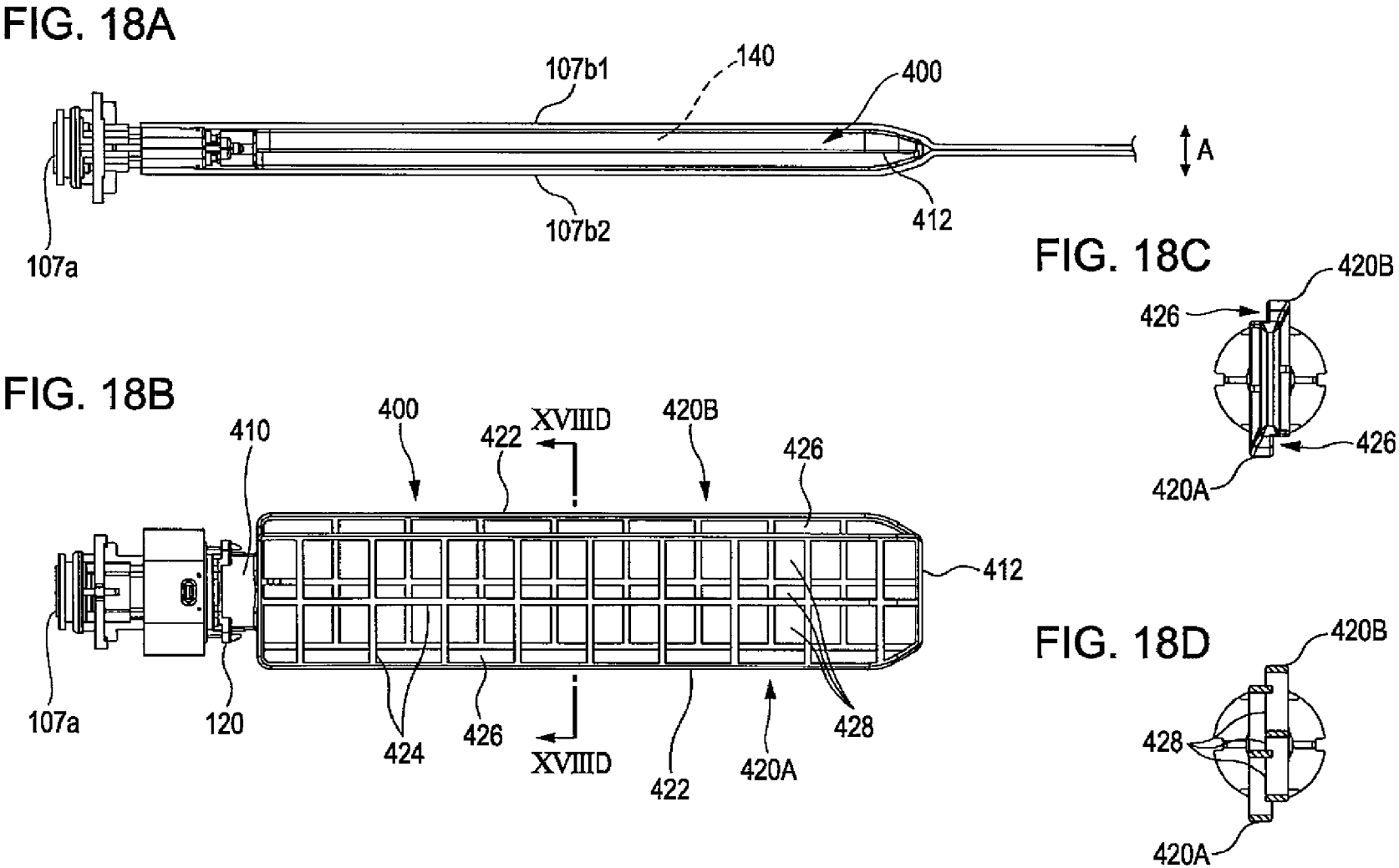
FIG. 18A is a view illustrating the spacer member according to the third embodiment, which is in contact between inner wall surfaces of two flexible films.
FIG. 18B is a front view illustrating the spacer member.
FIG. 18C is a right side surface view illustrating the spacer member.
FIG. 18D is a cross-sectional view taken along the line XVIIID-XVIIID of FIG. 18B.

FIG. 18A illustrates a state where the ink pack 107 deforms in the direction, in which inner wall surfaces of the two flexible films 107*b*1 and 107*b*2 of the ink pack 107 facing each other in the direction indicated by arrow A come close to each other, at the time of reduction in the amount of remaining ink as ink in the ink pack 107 is taken out through the ink lead-out member 107*a*. FIG. 18B is a front view illustrating a connection state of the ink lead-out member 107*a*, the check valve lid member 120, and the spacer member 400, FIG. 18C is a right side view, and FIG. 18D is a cross-sectional view taken along the line XVIIID-XVIIID of FIG. 18D. The spacer member 400 regulates contact between parts of inner wall surfaces of the two flexible films 107*b*1 and 107*b*2 facing each other at the time of reduction in the amount of remaining ink to thereby form the remaining ink space 140 where liquid remains.

The spacer member 400 includes a first end portion 410, which is connected to the ink lead-out member 107*a* with the check valve lid member 120 interposed therethrough, and a contact regulating member 420 extending from the first end portion 410 toward a second end portion 412. The contact regulating member 420 is in contact with the parts of the inner wall surfaces of the two flexible films 107*b*1 and 107*b*2 facing each other in order to regulate that the parts of the inner wall surfaces are brought into contact with each other.

In the first end portion 410 of the spacer member 400, a passage (first passage) of the ink lead-out member 107*a* and a second passage 414 communicating through the hole 124 of the check valve lid member 120 are provided as shown in FIG. 17. In addition, for example, two engaging holes 416 are formed in the first end portion 410. Two claw members 126, which are locked members formed in the check valve lid member 120, are engaged with the two engaging holes 416. As a result, the spacer member 400 is connected with the ink lead-out member 107*a* through the check valve lid member 120. In addition, a gap is set between the check valve lid member 128 and the first end portion 410 since the stopper 128 formed in the check valve lid member 120 comes in contact with the first end portion 410.

In the present embodiment, the contact regulating member 420 has first and second contact regulating members 420A and 420B that are disposed in the thickness direction of the spacer member 400 in two stages, and the first and second contact regulating members 420A and 420B disposed in two stages are arranged to deviate from each other in the width direction of the spacer member 400 (refer to FIGS. 18B to 18D).

Each of the first and second contact regulating members 420A and 420B has a predetermined height in the direction crossing the inner wall surfaces of the two flexible films 107*b*1 and 107*b*2 facing each other and has a ring-shaped outer shell member 422 that partitions the remaining ink space 140. Each of the first and second contact regulating members 420A and 420B further has a partition forming member 424 that has a grid shape, for example, and that partitions the remaining ink space 140 within the outer shell member 422 into a plurality of chambers 140A.

Here, the spacer member 400 is formed in a shape allowing ink to flow inside or outside the remaining ink space 140 even at the time of reduction in the amount of remaining ink. The outer shell member 422 has a predetermined height in the direction (direction indicated by arrow A shown in FIG. 18A) crossing the inner wall surfaces of the two flexible films 107*b*1 and 107*b*2 facing each other, and the remaining ink space 140 is formed by the outer shell member 422 and the flexible films 107*b*1 and 107*b*2. In this case, as shown in FIGS. 18B and 18C, an opening 426 in a region where the first and second contact regulating members 420A and 420B do not overlap in the width direction of the spacer member 400 is not blocked by the flexible films 107*b*1 and 107*b*2. For this reason, through the opening 426, ink can be made to flow inside or outside the remaining ink space 140, as indicated by arrows 430 and 432 shown in FIG. 17.

In addition, the partition forming member 424 is formed in a shape allowing ink to flow between adjacent ones of the plurality of chambers 140A. That is, as shown in FIGS. 18B and 18C, in the width direction and longitudinal direction of the spacer member 400, an opening 428 in a region where the partition forming members 424 of the first and second contact regulating members 420A and 420B do not overlap in the thickness direction is not blocked by the flexible films 107*b*1 and 107*b*2. For this reason, through the opening 428, ink can be made to flow between the adjacent chambers 140A of the remaining ink space 140, as indicated by arrows 434 and 436 shown in FIG. 17.

In addition, each of the first and second contact regulating members 420A and 420B does not necessarily need the outer shell member 422. This is because the remaining ink space 140 can be formed between the two flexible films 107*b*1 and 107*b*2 facing each other only by the grid-like partition forming member 424 (for example, a member having a fish bone shape). However, in the case where the outer shell member 422 is provided, both ends of the partition forming member 424 in the width direction are not exposed. Accordingly, the case is advantageous in that the spacer member 400 is easily inserted into the ink pack 107. Furthermore, when the outer shell member 422 includes a tapering tip whose height in the A direction becomes smaller as closer to the second end portion 412 as shown in FIG. 18A, it becomes easy to insert the spacer member 400 into the ink pack 107. To the contrary, the contact regulating member 420 may also be formed only by the outer shell member 422. However, there is a case where the flexible films 107*b*1 and 107*b*2 located inside the outer shell member 422 are bent and accordingly, the volume of the remaining ink space 140 originally designed may not be obtained. Therefore, it is preferable to form the partition forming member 424 together.

Operation of a Spacer Member

As described above, when the ink cartridge 100 (23) is mounted in the printer, the ink pack 107 (32) is deformed by pressure due to pressure air supplied from the pressure pump and then ink in the ink pack 107 (32) is taken out through the ink lead-out member 107*a* (32*b*).

FIG. 16 shows a state of the ink cartridge 100 attached to the printer, and the ink in the ink pack 107 shown in FIG. 16 tends to be taken out in the order of an upper region, a middle region, and a lower region. This is because ink in the lower ink pack region, which is a lower part in the gravity direction, tends to be taken out last.

On the other hand, for example, in the case of pigment ink in which a pigment used as coloring matter is dispersed in an ink solvent, the specific gravity of the pigment is larger than that of the ink solvent. Accordingly, the pigment tends to sediment in the lower region of the ink pack 107.

For this reason, the pigment ink taken out last from the ink pack 107 has a pigment concentration increased by the pigment that sediments. Discharge of such ink leads to a trouble of an apparatus or concentration unevenness at the time of printing. The amount of the ink with a high concentration is about several percent of the whole ink contained in the ink pack 107.

Therefore, in the present embodiment, ink that remains in the ink pack 107 to the last is contained in the remaining ink space 140 formed by the spacer member 400 between the two flexible films 107*b*1 and 107*b*2 facing each other, as shown in FIG. 18A. When the two flexible films 107*b*1 and 107*b*2 facing each other are brought into contact with each other except for the remaining ink space 140, the ink pack 107 does not deform any more even if pressure air from the pressure pump is supplied around the ink pack 107. As a result, the ink in the remaining ink space 140 cannot be taken out. Alternatively, the end of ink may be detected at timing when ink remains in the remaining ink space 140 by using a remaining amount sensor, for example, so that ink in the remaining ink space 140 is not taken out.

Here, before the two flexible films 107*b*1 and 107*b*2 facing each other start to come in contact with the spacer member 400, ink is taken outside the ink pack 107 by the pressure from the pressure pump regardless of existence of the spacer member 400. This is because input/output of ink to/from the spacer member 400 is completely free from openings formed at both ends of the cylindrical portion and through the holes 310 formed on the cylindrical peripheral surface since the two flexible films 107*b*1 and 107*b*2 facing each other are not in contact with the spacer member 400.

Even after the two flexible films 107*b*1 and 107*b*2 facing each other are brought into contact with the spacer member 400, ink can flow freely to the inside or outside of the remaining ink space 140 and to the inside or outside of the plurality of chambers 140A formed by partitioning of the remaining ink space 140 using the partition forming member 424. As a result, ink with high concentration, which sediments in the lower region within the ink pack 107, particularly in the neighborhood of the ink end can be free to move into the spacer member 400.

As described above, ink corresponding to several percent of volume that sediments in the lower region of the ink pack 107 is introduced into the remaining ink space 140 within the spacer member 400 in the neighborhood of the ink end before the remaining ink amount sensor detects the ink end and is held in the remaining ink space 140 at the time of ink detection.

Actually, according to the experiments of the inventors, the quality of a printed matter was maintained uniformly by causing ink held in the remaining ink space 140 not to be taken out at the time of ink detection. As a result, any trouble in the apparatus did not occur.

Fourth Embodiment

In the present embodiment, the spacer member 400 extending on the straight line of the passage of the ink lead-out member 107*a* in the third embodiment is replaced with a spacer member 700 in which a second end portion 712 deviates from a straight line of the passage of an ink lead-out member 107*a* and is thus positioned to deviate within an ink pack 107. Accordingly, since the present embodiment is the same as the third embodiment except for the structure and operation of the spacer member, an explanation on the same parts will be omitted. In addition, a member having the same function as in the third embodiment (includes the first embodiment) is denoted by the same reference numeral, and a detailed explanation thereof will be omitted or made simple.

Structure of a Spacer Member

Figure 19:
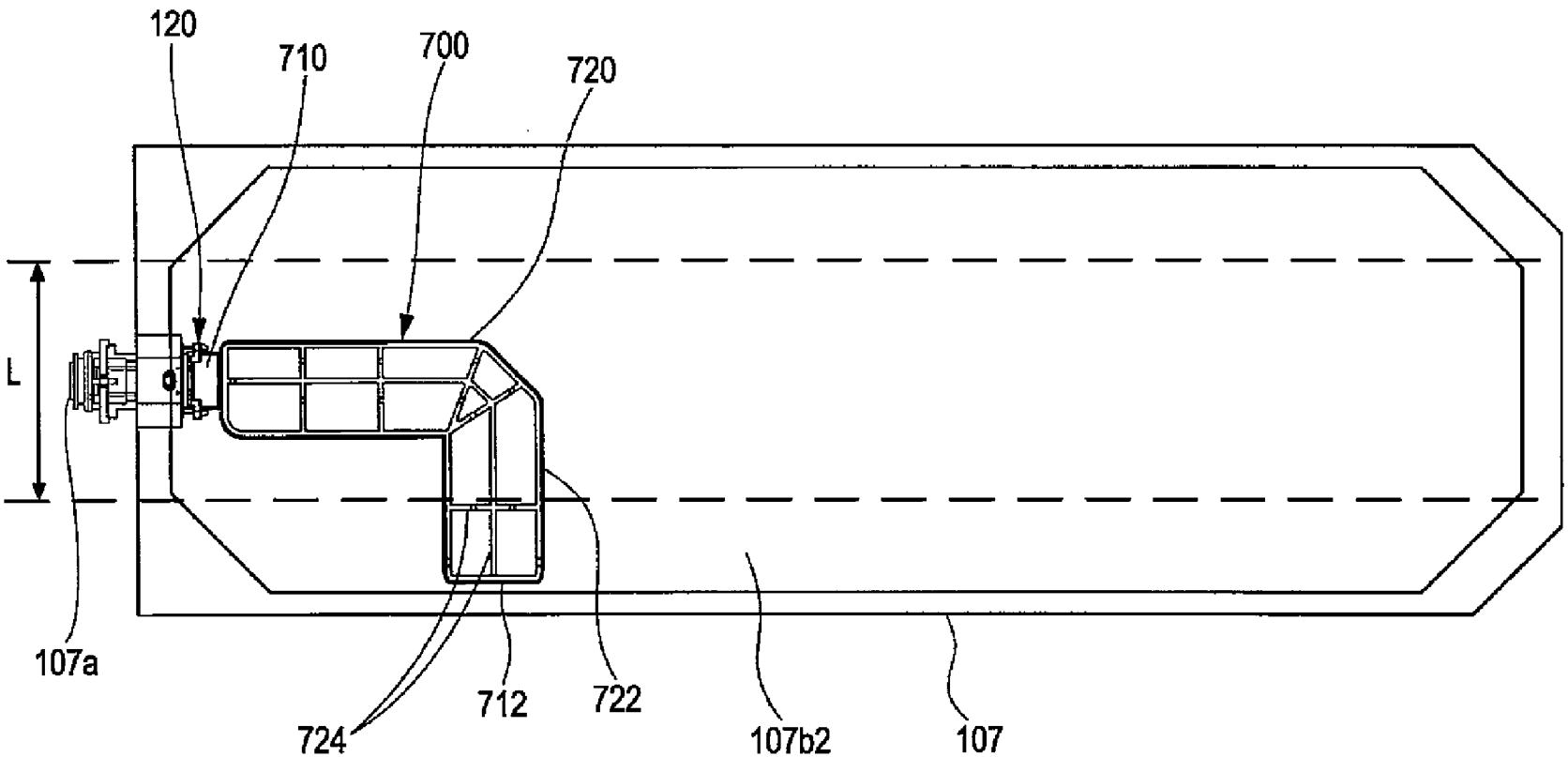
FIG. 19 is a view illustrating an ink pack having a spacer member according to a fourth embodiment of the invention.
Figure 20:
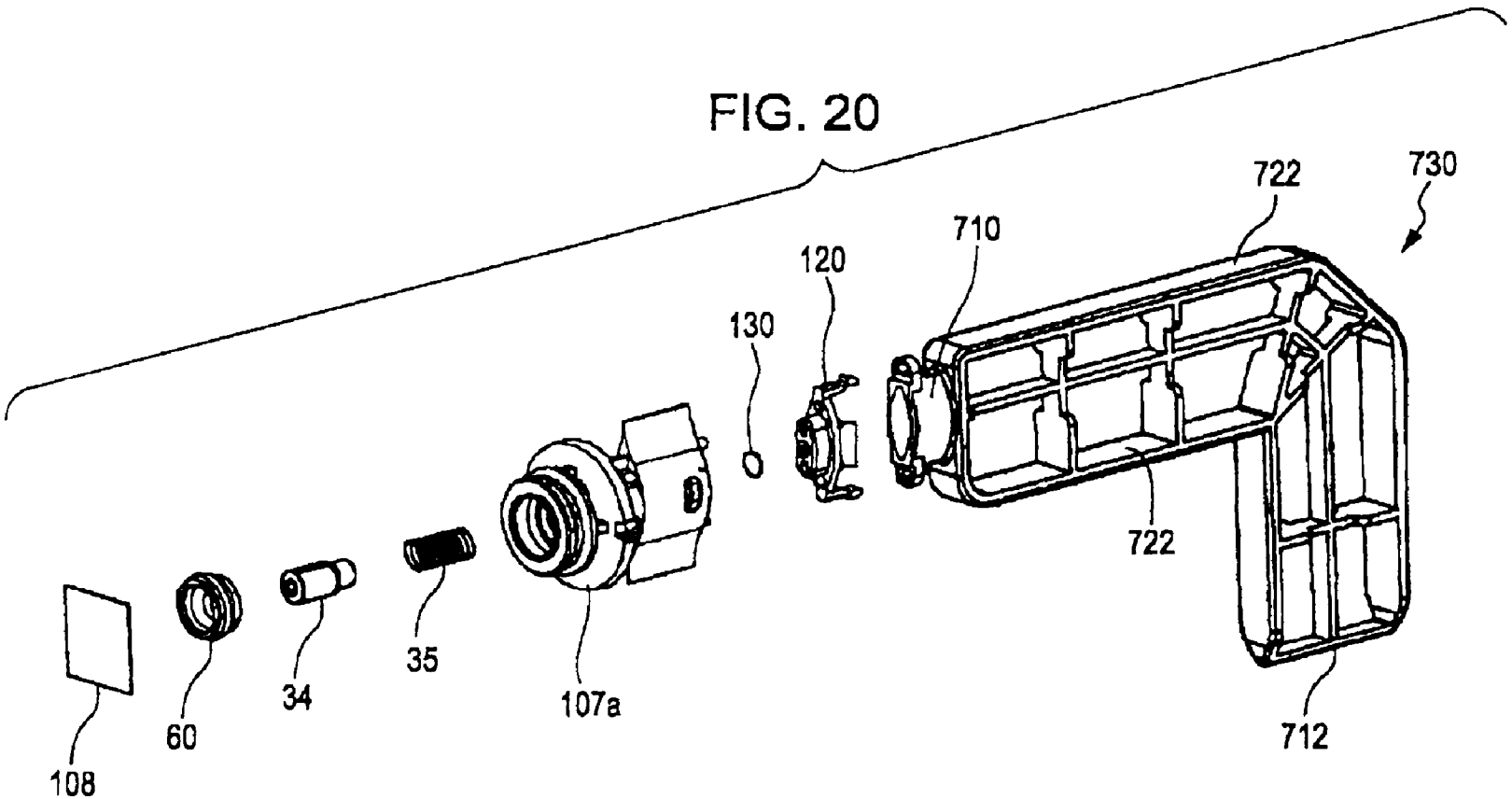
FIG. 20 is an exploded perspective view illustrating a state where the spacer member according to the fourth embodiment of the invention is connected to the ink lead-out member.

FIG. 19 is a view illustrating a spacer member 700 according to the fourth embodiment, which is connected to the ink lead-out member 107*a* shown in FIG. 9 and is disposed within the ink pack 107, and FIG. 20 is an exploded perspective view illustrating a state where the spacer member 700 is connected to the ink lead-out member 107*a* through the check valve lid member 120. In addition, FIGS. 21A to 21D illustrate the spacer member 700 according to the fourth embodiment. In addition, FIG. 19 illustrates a state where the top-surface-side flexible film 107*b*1 of the flexible films, which form the flexible bag 107*b* shown in FIG. 8, is removed and an inner wall surface of the bottom-surface-side flexible film 107*b*2 is exposed.

First, the spacer member 700 will be described with reference to FIGS. 21A to 21D and 20.

The spacer member 700 includes a first end portion 710, which is connected to the ink lead-out member 107*a* with the check valve lid member 120 interposed therethrough, and a contact regulating member 720 extending in the 'L' shape from the first end portion 710, and the tip of the contact regulating member 720 becomes the second end 712. In the spacer member 400 (refer to FIGS. 16, 17, and 18A to 18D) shown in a third embodiment, the first end portion 410 and the second end portion 412 are located on the straight line that connects the first passage of the ink lead-out member 107*a* with the second passage 414 of the first end portion 410. In the case of the spacer member 700, however, the second end portion 712 deviates from the straight line that connects first and second passages with each other and is thus disposed at the position deviating from the ink pack 107, as shown in FIG. 19. That is, the second end portion 712 is disposed at the position inclined toward a lower side within the ink pack 107 in the gravity direction.

The contact regulating member 720 has a predetermined height in the direction crossing the inner wall surfaces of the two flexible films 107*b*1 and 107*b*2 facing each other and has a ring-shaped outer shell member 722 that partitions the remaining ink space 140. The contact regulating member 720 further has a partition forming member 724 that has a grid shape, for example, and that partitions the remaining ink space 140 within the outer shell member 722 into a plurality of chambers 140A.

Figure 21C:
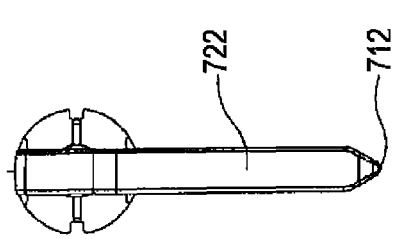
FIG. 21C is a right side surface view illustrating the spacer member.
Figure 21D:
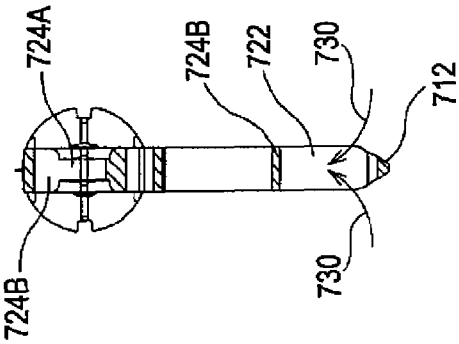
FIG. 21D is a cross-sectional view taken along the line XXID-XXID of FIG. 21B.

Here, the spacer member 700 is formed in a shape allowing ink to flow inside and outside the remaining ink space 140 even at the time of reduction in the amount of remaining ink. The outer shell member 722 has a predetermined height in the direction (direction indicated by arrow A shown in FIG. 21A) crossing the inner wall surfaces of the two flexible films 107*b*1 and 107*b*2 facing each other, and the remaining ink space 140 is formed by the outer shell member 722 and the flexible films 107*b*1 and 107*b*2. In this case, as shown in FIGS. 21B and 21C, in a relatively steeply tapering portion formed in the second end portion 712 of the spacer member 700, contact between the flexible films 107*b*1 and 107*b*2 are not good only with surrounding pressure. For this reason, through the opening on the first end portion 710, ink can be made to flow inside and outside the remaining ink space 140, as indicated by arrow 730 shown in FIG. 21D.

In addition, the partition forming member 724 is formed in a shape allowing ink to flow between adjacent ones of the plurality of chambers 140A. That is, as shown in FIGS. 20 and 21D that is a cross-sectional view taken along the line XXID-XXID of FIG. 21B, the height of a middle region 724A is lower than those of both end regions 724B in the partition forming member 724. Accordingly, as shown in FIG. 21B, the two chambers 140A partitioned in the middle region 724A of the partition forming member 724 with the lower height are not completely blocked by the flexible films 107*b*1 and 107*b*2. As a result, ink can flow between the adjacent chambers 140A of the remaining ink space 140, as indicated by arrows 732 and 734 shown in FIG. 21B.

In addition, the contact regulating member 720 does not necessarily need the outer shell member 722, which is the same as in the third embodiment.

Operation of a Spacer Member

FIG. 19 shows a state of the ink cartridge attached to the printer, and the ink in the ink pack 107 shown in FIG. 19 tends to be taken out in the order of an upper region, a middle region, and a lower region, which is also the same as in the third embodiment. Ink positioned in the lower region of the ink pack, which is a lower side in the gravity direction, is taken out last and a pigment tends to sediment in the lower region of the ink pack 107, which are the same as in the third embodiment.

Figure 21A:
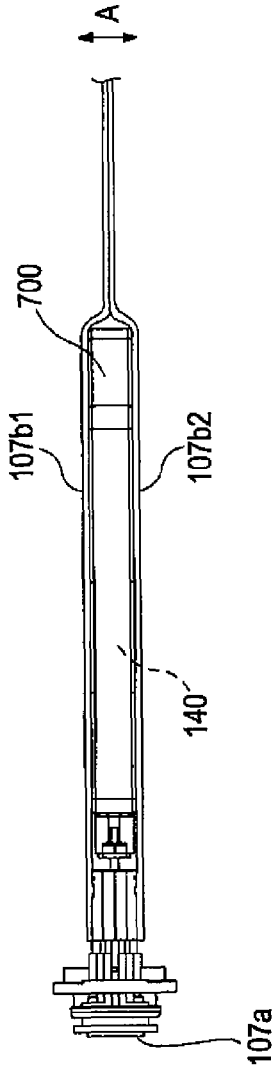
FIG. 21A is a view illustrating the spacer member according to the fourth embodiment, which is in contact between inner wall surfaces of two flexible films.
Figure 21B:
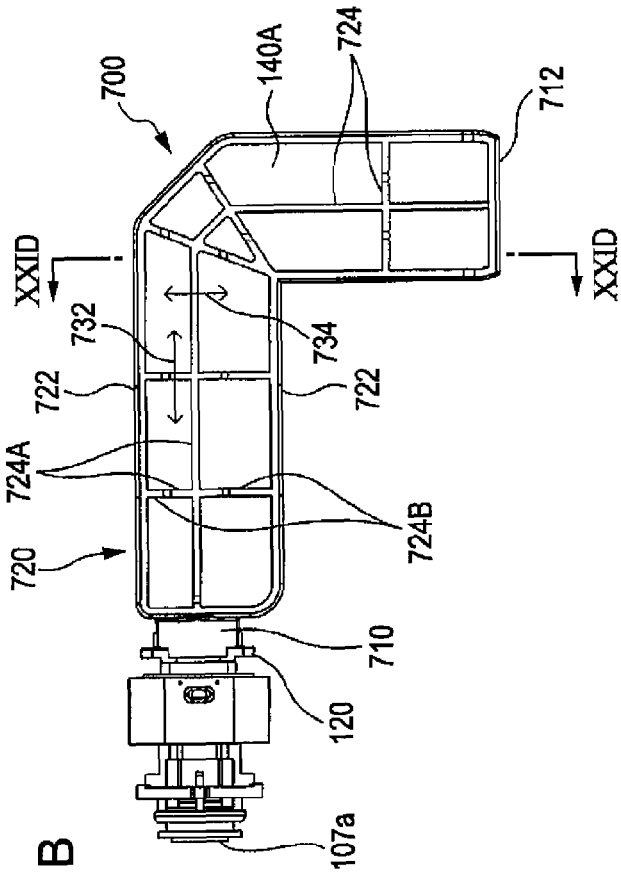
FIG. 21B is a front view illustrating the spacer member.

Also in the present embodiment, ink that remains in the ink pack 107 to the last is contained in the remaining ink space 140 formed by the spacer member 700 between the two flexible films 107*b*1 and 107*b*2 facing each other, as shown in FIG. 21A. The end of ink is detected at timing when ink remains in the remaining ink space 140 by using a remaining amount sensor, for example, so that ink in the remaining ink space 140 is not taken out.

Here, even after the two flexible films 107*b*1 and 107*b*2 facing each other are brought into contact with the spacer member 700, communication between the inside of the remaining ink space 140 and the lower region of the ink pack 107 can be performed due to an ink flow path 730 secured in the second end portion 712 shown in FIG. 21D. As described above, ink corresponding to several percent of volume that sediments in the lower region of the ink pack 107 is introduced into the remaining ink space 140 within the spacer member 700 in the neighborhood of the ink end before the remaining ink amount sensor detects the ink end and is held in the remaining ink space 140 at the time of ink detection.

Actually, according to the experiments of the inventors, the quality of a printed matter was maintained uniformly by causing ink held in the remaining ink space 140 of the spacer member 700 not to be taken out at the time of ink end detection. As a result, any trouble in the apparatus did not occur.

Modifications

In addition, applications of the liquid storage containers according to the first to fourth embodiments of the invention are not limited to the ink cartridge of the ink jet recording apparatus. For example, the liquid storage container may be applied to various kinds of liquid consuming apparatuses provided with liquid ejecting heads from which a small amount of liquid droplets are discharged.

While the present embodiments have been described in detail, it could be easily understood by one skilled in the art that various changes and modifications thereof could be made without departing from novel matters and effects of the invention. Therefore, such all modifications still fall within the scope of the invention. For example, in this specification or the drawings, a term which is described at least once together with different terms having a broader meaning or the same meaning can be replaced with the different terms in any parts of the specification or drawings.

As the spacer member, a space member having any shape may be used as long as the space member regulates contact between parts of inner wall surfaces of the two flexible films 107*b*1 and 107*b*2 facing each other at the time of reduction in the amount of remaining ink to thereby form a remaining ink space where liquid remains.

Figure 22A:
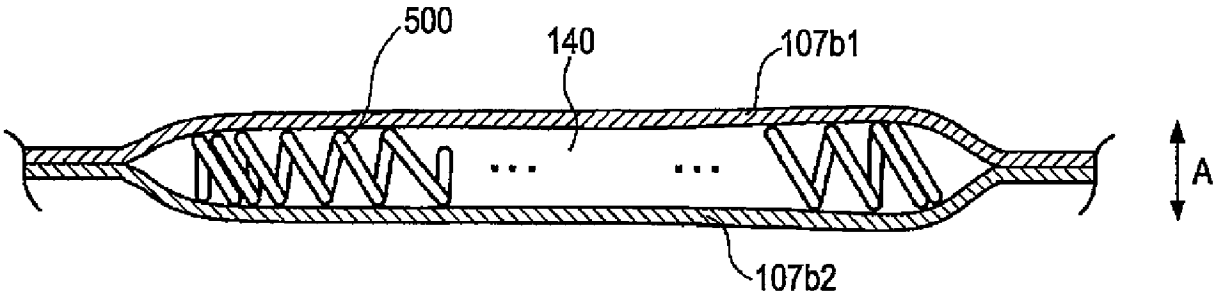
FIG. 22A is a cross-sectional view illustrating an ink pack having a spacer member according to a modified example, which can be elastically deformed.
Figure 22B:
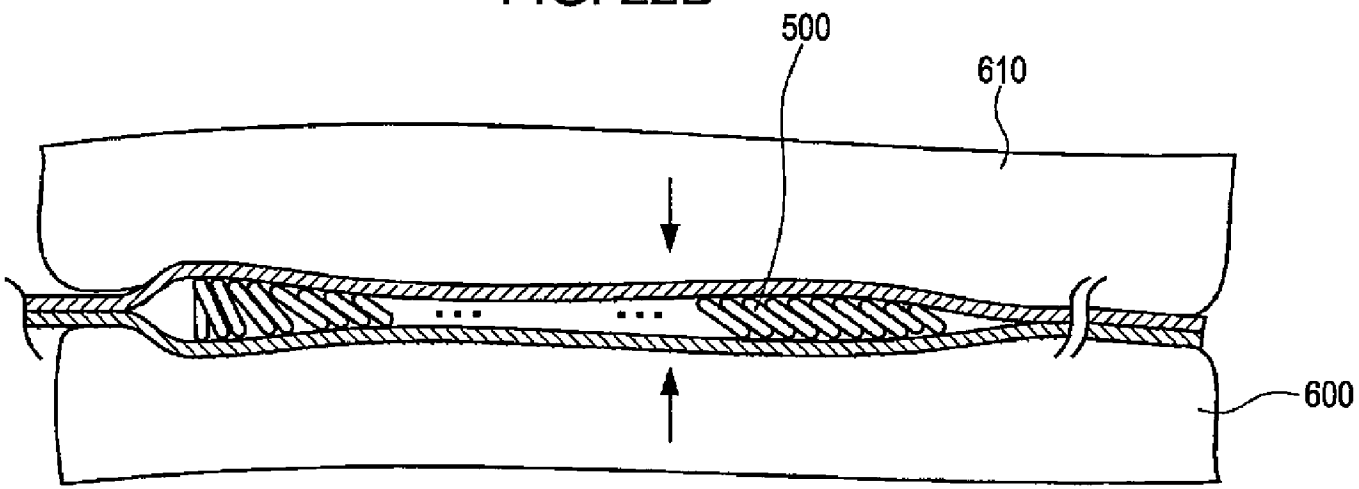
FIG. 22B is a cross-sectional view illustrating a state where the spacer member is elastically deformed within the ink pack.

For example, FIGS. 22A and 22B illustrate a spacer member (contact regulating member) 500 with a coil shape that is elastically deformed by overpressure. Pressure for deformation in the direction where inner wall surfaces of the two flexible films 107*b*1 and 107*b*2 facing each other are brought into contact with each other when liquid, such as ink, is taken out is set as first pressure. Here, second excessive pressure exceeding the first pressure is given, for example, mechanically between pressure members 600 and 610 at the time of exhaust shown in FIG. 12A (refer to FIG. 22B). In this way, the coil-shaped spacer member 500 can be made to elastically deform in the direction in which the remaining ink space 140 is reduced, as shown in FIG. 22B. As a result, a process of exhausting air in the remaining ink space 140 shown in FIG. 12B can be omitted, or the process of exhausting air in the remaining ink space 140 can be shortened by reducing the amount of filled ink.

In addition, in the refilling method of refilling ink into the ink cartridge 107 in a state the ink cartridge is recovered from the market after ink in the ink cartridge having the spacer member 500 shown in FIG. 22A is taken out, remaining ink within the ink pack 107 is discharged by elastically deforming the spacer member 500 and the air in the ink pack 107 is exhausted by sucking the air as shown in FIG. 22B. Then, it can prevent that air is introduced into the ink pack 107 by refilling ink into the ink pack 107.

In addition, in the various kinds of embodiments described above, the spacer members 200, 300, and 500 have been provided in the lower part of the flexible bag 107*b* in the gravity direction. However, the position of the spacer member is not limited to the above part. For example, in the case of ink containing a pigment, ink which contains a small amount of pigment and has a low concentration may be taken out before the pigment sediments and ink with a high concentration is taken out. Ink with a low concentration is stored in an upper part of a liquid containing body in the gravity direction. Accordingly, the spacer member may be formed of a material whose specific gravity is lower than liquid and be disposed at the position other than a lower part of the flexible bag 107*b* in the gravity direction. In addition, the spacer members 200, 300, and 500 may be replaced with the spacer member 400 in the third embodiment, and then the spacer member 400 may be used in a state where the spacer member 400 is engaged with the ink lead-out member 107*a* and is disposed on the approximately straight line of the passage of the ink lead-out member 107*a*. In addition, the spacer member 400 may be used in a state where the spacer member 400 is inserted into the flexible bag 107*b* without being engaged with the ink lead-out member 107*a*.

Specific examples of the liquid consuming apparatus or the liquid ejecting apparatus include an apparatus provided with a color material ejecting head used to manufacture a color filter for a liquid crystal display or the like, an apparatus provided with an electrode material (conductive paste) ejecting head used to form an electrode of an organic EL display, a surface emission display (FED), or the like, an apparatus provided with a bioorganic material ejecting head used to manufacture a biochip, an apparatus provided with a sample ejecting head as a precision pipette, a textile printing apparatus, a microdispenser, and the like.

In the embodiments described above, the liquid ejecting apparatus may be embodied as a so-called full line type (line head type) printer in which the recording head 20 in the direction crossing the transport direction (front and back direction) of recording paper (not shown) forms the entire shape corresponding to the length of the width direction (left and right direction) of the recording paper (not shown).

Even though the liquid ejecting apparatus is embodied as the ink jet printer 11 in the above-described embodiments, the invention is not limited thereto. The liquid ejecting apparatus may also be embodied as a liquid ejecting apparatus that ejects or discharges liquid (including a liquid-like body, in which particles of a functional material are dispersed or mixed in liquid, and a fluid-like body, such as gel) other than ink. For example, a liquid ejecting apparatus that ejects a liquid-like body containing a material used for manufacturing a liquid crystal display, an EL (electroluminescent) display, and a surface-emitting display, such as an electrode material or a color material (pixel material), in the form of dispersion or solution, a liquid ejecting apparatus that ejects a bioorganic material used for manufacturing a biochip, or a liquid ejecting apparatus that ejects liquid as a sample used as a precision pipet may also be used. In addition, a liquid ejecting apparatus that ejects lubricating oil to precision instruments, such as a watch and a camera, by pinpoint, a liquid ejecting apparatus that ejects transparent resin liquid, such as ultraviolet curing resin, onto a substrate in order to form a fine hemispherical lens (optical lens) used for an optical communication device or the like, a liquid ejecting apparatus that ejects acid etching liquid or alkali etching liquid in order to etch a substrate or the like, or a fluid ejecting apparatus that ejects a fluid-like body, such as gel (for example, physical gel) may also be used. In addition, the invention may be applied to any one of the light ejecting apparatuses described above. In addition, in this specification, 'liquid' is a concept not including liquid containing only gas, and examples of the liquid include a liquid-like body and a fluid-like body as well as an inorganic solvent, an organic solvent, a solution, liquid-like resin, and a liquid-like metal (liquid in which metal is melted).

The entire disclosure of Japanese Patent Nos: 2007-180528, filed Jul. 10, 2007, 2007-180529, filed Jul. 10, 2007 and 2008-125576, filed May 13, 2008 are expressly incorporated by reference herein.

What is claimed is:

1. A liquid storage container comprising:

a liquid containing body to contain liquid therein and is formed of a flexible film;

a liquid lead-out member connected to the liquid containing body; and a spacer member in the shape of a coil spring disposed in the liquid containing body, wherein the liquid containing body deforms in a direction in which inner wall surfaces of the flexible film facing each other are brought into contact with each other at the time of reduction in the remaining amount of the liquid as the inside liquid is taken out through the liquid lead-out member, and the spacer member includes a contact regulating member that is in contact with parts of the inner wall surfaces of the flexible film facing each other at the time of reduction in the remaining amount of the liquid to thereby regulate contact between the parts of the inner wall surfaces and to form a remaining liquid space where liquid remains;

wherein, assuming that pressure for deformation in a direction where the inner wall surfaces of two flexible films facing each other are brought into contact with each other when the liquid is taken out is set at a first pressure, the contact regulating member elastically deforms in a direction in which the remaining liquid space is reduced when a second pressure exceeding the first pressure is given;

wherein the spacer member is disposed at a lower side of the liquid containing body in the gravity direction, and wherein the liquid in the liquid containing body comprises pigment ink.

2. The liquid storage container according to claim 1, wherein the spacer member is formed of a material having a larger specific gravity than the liquid.

3. The liquid storage container according to claim 1, further comprising:

a weight member that is connected to the spacer member and serves to dispose the spacer member at the lower side of the liquid containing body in the gravity direction, wherein the spacer member is formed of a material having a smaller specific gravity than the liquid.

4. The liquid storage container according to claim 1, wherein the contact regulating member is formed in a shape allowing the liquid to flow inside and outside the remaining liquid space.

5. The liquid storage container according to claim 4, wherein the contact regulating member includes a partition forming member that partitions the remaining liquid space into a plurality of chambers, and the partition forming member is formed in a shape allowing the liquid to flow between adjacent ones of the plurality of chambers.

6. The liquid storage container according to claim 1, wherein the contact regulating member includes an outer shell member that has a predetermined height in a direction crossing the inner wall surfaces facing each other and partitions the remaining liquid space.

7. The liquid storage container according to claim 1, wherein the liquid contains a plurality of kinds of components, and the specific gravity of at least one kind of component is larger than that of another kind of component.

8. A liquid filling method of filling liquid into the liquid storage container according to claim 1, the method comprising:

forming a space by deforming the flexible film in the direction in which the inner wall surfaces of the flexible film facing each other are brought into contact with each other, and in a state in which the spacer member is disposed at the position opposite the liquid lead-out member to thereby exhaust the air within the liquid containing body and regulating contact between parts of the inner wall surfaces of the flexible film facing each other at the time of exhaust by the use of the spacer member;

injecting a predetermined amount of liquid into the liquid containing body including the space formed in the spacer member in a state where the liquid lead-out member faces upward in the gravity direction and then exhausting the air again; and filling the liquid containing body with liquid.

9. A liquid filling method of filling the liquid into the liquid storage container according to claim 1, comprising:

exhausting the air within the liquid containing body by elastically deforming the contact regulating member under a second pressure in a state where to spacer member is disposed at the position opposite the liquid lead-out member; and filling the liquid containing body with the liquid.

10. A liquid refilling method of refilling the liquid into the liquid containing body after the liquid in the liquid storage container according to claim 1 has been consumed, comprising:

discharging liquid remaining within the remaining liquid space in a state where the spacer member is disposed at the position opposite the liquid lead-out member;

exhausting the air from the space within the spacer member after injecting a predetermined amount of liquid into the liquid containing body including the space formed in the spacer member in a state where the liquid lead-out member faces upward in the gravity direction; and refilling the liquid containing body with liquid.

11. A liquid refilling method of refilling liquid into a liquid storage container after liquid therein has been consumed, the liquid storage containing comprising a liquid containing body to contain liquid therein and is formed of a flexible film; a liquid lead-out member connected to the liquid containing body; and a spacer member in the shape of a coil spring disposed at a lower side of the liquid containing body in the gravity direction, wherein the liquid containing body deforms in a direction in which inner wall surfaces of the flexible film facing each other are brought into contact with each other at the time of reduction in the remaining amount of the liquid as the inside liquid is taken out through the liquid lead-out member, the spacer member regulating contact between parts of the inner wall surfaces of the flexible film facing each other at the time of reduction in the remaining amount of the liquid to thereby form a remaining liquid space where liquid remains, the liquid refilling method comprising:

discharging remaining liquid within the remaining liquid space and exhausting the air within the liquid containing body by elastically deforming the contact regulating member under a pressure in a state where the spacer member is disposed at the position opposite the liquid lead-out member; and refilling the liquid containing body with the liquid.

* * * * *